US011095033B2

(12) United States Patent
Li et al.

(10) Patent No.: US 11,095,033 B2
(45) Date of Patent: Aug. 17, 2021

(54) ANTENNA APPARATUS AND TERMINAL

(71) Applicant: Huawei Technologies Co., Ltd., Shenzhen (CN)

(72) Inventors: Kun Li, Xi'an (CN); Chien-ming Lee, Shanghai (CN); Bao Lu, Shenzhen (CN); Silei Huyan, Xi'an (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/754,497

(22) PCT Filed: Dec. 28, 2017

(86) PCT No.: PCT/CN2017/119244
§ 371 (c)(1),
(2) Date: Apr. 8, 2020

(87) PCT Pub. No.: WO2019/071847
PCT Pub. Date: Apr. 18, 2019

(65) Prior Publication Data

US 2020/0381828 A1 Dec. 3, 2020

(30) Foreign Application Priority Data

Oct. 9, 2017 (CN) ..... 201710930937.2

(51) Int. Cl.
*H01Q 1/24* (2006.01)
*H01Q 5/00* (2015.01)
(Continued)

(52) U.S. Cl.
CPC ..... *H01Q 5/328* (2015.01); *H01Q 1/243* (2013.01); *H01Q 5/10* (2015.01); *H01Q 5/30* (2015.01); *H01Q 5/35* (2015.01)

(58) Field of Classification Search
CPC ..... H01Q 5/328; H01Q 5/10; H01Q 5/335; H01Q 1/243; H01Q 7/00; H01Q 5/35;
(Continued)

(56) References Cited

U.S. PATENT DOCUMENTS 8,798,554 B2 8/2014 Darnell et al.
8,942,761 B2 * 1/2015 Vance ..... H01Q 5/314 455/550.1
(Continued)

FOREIGN PATENT DOCUMENTS

CN 202111228 U 1/2012
CN 203277656 U 11/2013
(Continued)

*Primary Examiner* — Vibol Tan
(74) *Attorney, Agent, or Firm* — Conley Rose, P.C.

(57) ABSTRACT

An antenna apparatus includes a radiator and two feeding branch circuits, where a first feeding branch circuit includes a first feedpoint and a first filter circuit electrically coupled between the first feedpoint and the radiator, and where the first feedpoint is configured to feed a first signal of a first frequency band. A second feeding branch circuit includes a second feedpoint and a second filter circuit electrically coupled between the second feedpoint and the radiator, with the second feedpoint configured to feed a second signal of a second frequency band. The first filter circuit is configured to allow the first signal to pass through and ground the second signal. The second filter circuit is configured to allow the second signal to pass through and ground the first signal.

20 Claims, 13 Drawing Sheets

(51) Int. Cl.

| | |
|---|---|
| ***H01Q 5/328*** | (2015.01) |
| ***H01Q 5/10*** | (2015.01) |
| ***H01Q 5/30*** | (2015.01) |
| ***H01Q 5/35*** | (2015.01) |

(58) Field of Classification Search
CPC ..... H01Q 5/30; H01Q 5/314; H01Q 1/2291; H01Q 5/371; H01Q 5/00; H01Q 5/20
See application file for complete search history.

(56) References Cited

U.S. PATENT DOCUMENTS

| | | | | |
|---|---|---|---|---|
| 9,472,848 | B2 * | 10/2016 | Pajona | H01Q 5/307 |
| 10,270,171 | B2 * | 4/2019 | Yong | H01Q 9/0421 |
| 10,879,590 | B2 * | 12/2020 | Li | H01Q 5/328 |
| 2007/0146221 | A1 | 6/2007 | Oshiyama et al. | |
| 2010/0279734 | A1 | 11/2010 | Karkinen et al. | |
| 2011/0183633 | A1 | 7/2011 | Ohba et al. | |
| 2013/0102357 | A1 * | 4/2013 | Vance | H01Q 5/307 455/550.1 |
| 2013/0127677 | A1 | 5/2013 | Lin et al. | |
| 2013/0214979 | A1 | 8/2013 | McMilin et al. | |
| 2014/0078007 | A1 | 3/2014 | Abe | |
| 2015/0188225 | A1 * | 7/2015 | Chang | H01Q 1/243 343/702 |
| 2017/0338560 | A1 | 11/2017 | Li et al. | |

FOREIGN PATENT DOCUMENTS

| | | | |
|---|---|---|---|
| CN | 103534873 | A | 1/2014 |
| CN | 103682578 | A | 3/2014 |
| CN | 104425872 | A | 3/2015 |
| CN | 104505589 | A | 4/2015 |
| CN | 105337040 | A | 2/2016 |
| CN | 105490026 | A | 4/2016 |
| KR | 20070069074 | A | 7/2007 |
| KR | 101424535 | B1 | 8/2014 |
| WO | 2011024280 | A1 | 3/2011 |

* cited by examiner

ANTENNA APPARATUS AND TERMINAL

CROSS-REFERENCE TO RELATED APPLICATIONS

This application is a U.S. National Stage of International Patent Application No. PCT/CN2017/119244 filed on Dec. 28, 2017, which claims priority to Chinese Patent Application No. 201710930937.2 filed on Oct. 9, 2017, both of which are hereby incorporated by reference in their entireties.

TECHNICAL FIELD

This application relates to the field of antenna technologies, and in particular, to a loop (loop) antenna apparatus.

BACKGROUND

A loop (loop) antenna is widely used in a mobile terminal product. A conventional loop antenna includes a feedpoint and a ground point, so that signals of different frequency bands (for example, a high frequency signal and a low frequency signal) match by using a same matching circuit. When a low frequency range is adjusted, a location of high frequency impedance changes. Similarly, when a high frequency range is adjusted, a location of low frequency impedance changes. Impact of high frequency matching on a low frequency signal cannot be eliminated, and impact of low frequency matching on a high frequency signal cannot be eliminated. Consequently, the antenna cannot be matched to an optimal status.

SUMMARY

Embodiments of this application provide an antenna apparatus, and the antenna apparatus has a good matching status, so that wider bandwidth is implemented.

According to one aspect, an embodiment of this application provides an antenna apparatus. The antenna apparatus includes a first feeding branch circuit, a second feeding branch circuit, and a radiator connected between the first feeding branch circuit and the second feeding branch circuit.

The first feeding branch circuit includes a first feedpoint and a first filter circuit electrically connected between the first feedpoint and the radiator, where the first feedpoint is configured to feed a signal of a first frequency band.

The second feeding branch circuit includes a second feedpoint and a second filter circuit electrically connected between the second feedpoint and the radiator, and the second feedpoint is configured to feed a signal of a second frequency band.

The first filter circuit is configured to: allow the signal of the first frequency band to pass through, and ground the signal of the second frequency band.

The second filter circuit is configured to: allow the signal of the second frequency band to pass through, and ground the signal of the first frequency band.

The first filter circuit and the second filter circuit are disposed, the first filter circuit allows the signal that is of the first frequency band and that is fed by the first feedpoint to pass through, and hinders the signal that is of the second frequency band and that is fed by the second feedpoint, and the second filter circuit allows the signal that is of the second frequency band and that is fed by the second feedpoint to pass through, and hinders the signal that is of the first frequency band and that is fed by the first feedpoint. In this way, it is equivalent to that the antenna apparatus implements, on one radiator, functions of equivalent antennas in two different frequency band ranges (for example, a low frequency and a high frequency), so that the antenna apparatus has a good matching status, has multi-frequency performance, extends antenna bandwidth, and can be applied in a multi-frequency terminal.

In an implementation, the first feeding branch circuit further includes a first matching circuit electrically connected between the first feedpoint and the first filter circuit, configured to adjust a resonance frequency of the signal of the first frequency band; and the second feeding branch circuit further includes a second matching circuit electrically connected between the second feedpoint and the second filter circuit, configured to adjust a resonance frequency of the signal of the second frequency band.

The first matching circuit and the second matching circuit are disposed, so that the signal of the first frequency band and the signal of the second frequency band match by using different matching circuits. In this way, interference of signals of different frequencies (for example, a high frequency signal and a low frequency signal) to each other may not be caused, antenna bandwidth can be extended, and multi-frequency performance is implemented.

In an implementation, the first feeding branch circuit and the second feeding branch circuit are symmetrically disposed on two sides of a centerline, and the radiator has an architecture symmetrically distributed along the centerline. Specifically, the radiator includes a first area, a second area, and a third area. The first area and the third area are disposed on two opposite sides of the second area. The first feeding branch circuit and the second feeding branch circuit are electrically connected to the second area, and the centerline is a centerline of the second area. The first area and the third area are symmetrically distributed on two sides of the second area. According to the foregoing disposing, the radiator may alternatively be of a symmetrical structure along the second area. The first feeding branch circuit and the second feeding branch circuit are symmetrical along the centerline, so that the centerline passes through a center of the second area of the radiator. In this case, the antenna apparatus is of a symmetrical structure along the centerline in general, and the structure is simple and easy to implement.

The foregoing disposing facilitate arrangement of locations of the first feeding branch circuit and the second feeding branch circuit on a terminal, so that a length of a feeder that electrically connects a chip of the terminal to the first feeding branch circuit may be determined in advance, and in this way, impedance matching of the antenna apparatus may be adjusted.

In an implementation, the first feeding branch circuit includes a first inductor, a second inductor, a third inductor, a first capacitor, and a second capacitor. The second inductor is connected in series between the first feedpoint and a ground. The first inductor and the third inductor are successively connected in series between the ground and an end that is of the second inductor and that is far away from the ground. The first capacitor and the second capacitor are successively connected in series between the ground and an end that is of the third inductor and that is far away from the ground. The radiator is electrically connected to an end that is of the second capacitor and that is far away from the ground. The first inductor, the second inductor, and the third inductor form the first matching circuit, and the first capacitor and the second capacitor form the first filter circuit.

According to the foregoing disposing, a function of allowing the signal of the first frequency band to pass through and hindering the signal of the second frequency band by the first filter circuit in an implementation is implemented, and a function of performing impedance matching by the first matching circuit in an implementation is implemented. Certainly, the foregoing implementations impose no limitation on specific architectures of the first filter circuit and the first matching circuit in this application.

In an implementation, the second feeding branch circuit includes a third capacitor, a fourth capacitor, a fourth inductor, and a fifth inductor. The third capacitor is connected in series between the second feedpoint and the ground. The fourth inductor is connected in series between the ground and an end that is of the third capacitor and that is far away from the ground. The fourth capacitor and the fifth inductor are successively connected in series between the ground and an end that is of the fourth inductor and that is far away from the ground. The third capacitor forms the second matching circuit, and the fourth inductor, the fourth capacitor, and the fifth inductor form the second filter circuit.

Similarly, the foregoing implementations impose no limitation on specific architectures of the second filter circuit and the second matching circuit in this application.

In an implementation, the radiator includes a first area, a second area, and a third area. The first area and the third area are disposed on two opposite sides of the second area. The first feeding branch circuit and the second feeding branch circuit are electrically connected to the first area. Specifically, the first feeding branch circuit and the second feeding branch circuit are symmetrically distributed on two sides of a first centerline. The radiator has an architecture symmetrically distributed along a second centerline. The first centerline deviates from the second centerline, and the first centerline and the second centerline are not collinear. In this way, an offset feeding structure forms in the antenna apparatus.

According to the foregoing disposing, a location of a component when being arranged on the terminal may be avoided, so that arrangement of the antenna apparatus is more flexible.

In an implementation, the antenna apparatus further includes a first switch and at least one ground branch. The at least one ground branch is connected in parallel between the first switch and the ground. The first switch is electrically connected to the radiator and is disposed on a side of the radiator that is close to the second feeding branch circuit. The first switch cooperates with the at least one ground branch to switch an electrical length of the signal of the first frequency band.

The first switch is disposed, so that the first switch can cooperate with the at least one ground branch to switch the electrical length of the signal of the first frequency band.

In an implementation, an impedance component is disposed on each ground branch to adjust an electrical length of the radiator.

Bandwidth of the first frequency band may be extended by disposing the first switch, the ground branch, and the impedance component.

In an implementation, the antenna apparatus further includes a radiation branch, a second switch, a first ground branch, and at least one second ground branch. The first ground branch is connected in series between the second switch and the second filter circuit. The at least one second ground branch is connected in parallel between the second switch and the ground. The radiation branch is electrically connected to an end that is of the second filter circuit and that is connected to the first ground branch.

The second switch cooperates with the first ground branch or the at least one second ground branch, so that a plurality of operating modes of the antenna apparatus can be implemented. In this way, the antenna apparatus has multi-frequency performance, and resonance frequencies of a high frequency signal and a low frequency signal can be adjusted.

In an implementation, the radiation branch is disposed to be separated from the radiator, and a physical electrical length of the radiation branch is less than the physical electrical length of the radiator.

The physical electrical length of the radiation branch is set to be less than the physical electrical length of the radiator, so that a radiation requirement of the signal of the second frequency band can be met. To avoid mutual radiation interference, the radiation branch needs to be separated from the radiator by a specific distance, to ensure sufficient antenna isolation.

In an implementation, the first feeding branch circuit includes a first capacitor, a second capacitor, a third capacitor, a first inductor, a second inductor, a third inductor, and a fourth inductor. The second capacitor is connected in series between the second feedpoint and a ground. The second inductor is connected in series between the ground and an end that is of the second capacitor and that is far away from the ground. The first capacitor, the first inductor, and the third inductor are successively connected in series between the ground and an end that is of the second inductor and that is far away from the ground. The fourth inductor and the third capacitor are successively connected in series between the ground and an end that is of the third inductor and that is far away from the ground. The radiator is electrically connected to an end that is of the fourth inductor and that is far away from the ground. The first capacitor, the second capacitor, the first inductor, and the second inductor form the first matching circuit, and the third capacitor, the third inductor, and the fourth inductor form the first filter circuit.

According to the foregoing disposing, the function of allowing the signal of the first frequency band to pass through and hindering the signal of the second frequency band by the first filter circuit is implemented, and the function of performing impedance matching by the first matching circuit is implemented.

In an implementation, the second feeding branch circuit includes a fourth capacitor, a fifth capacitor, a fifth inductor, a sixth inductor, and a seventh inductor. The fifth inductor is connected in series between the second feedpoint and the ground. The fourth capacitor, the fifth capacitor, and the seventh inductor are successively connected in series between the ground and an end that is of the fifth inductor and that is far away from the ground. The sixth inductor is connected in parallel to two ends of the fifth capacitor. The radiator is electrically connected to an end that is of the seventh inductor and that is far away from the ground. The fourth capacitor and the fifth inductor form the second matching circuit, and the fifth capacitor, the sixth inductor, and the seventh inductor form the second filter circuit.

According to the foregoing disposing, a function of allowing the signal of the second frequency band to pass through and hindering the signal of the first frequency band by the second filter circuit is implemented, and a function of performing impedance matching by the second matching circuit is implemented.

In an implementation, the antenna apparatus further includes a duplexer. The duplexer includes an input port, a first output port, and a second output port. The first output port is configured as the first feedpoint, the second output port is configured as the second feedpoint. The first filter circuit is electrically connected to the first output port, the second filter circuit is electrically connected to the second output port. The antenna apparatus further includes a general feedpoint. The general feedpoint is electrically connected to the input port.

The duplexer is disposed, so that a quantity of feedpoints is reduced. This facilitates a space layout of components inside a terminal.

According to another aspect, an embodiment of this application further provides a terminal. The terminal includes a mainboard and the antenna apparatus according to any one of the implementations of the foregoing aspect. A first feeding branch circuit and a second feeding branch circuit of the antenna apparatus are disposed on the mainboard.

The first feeding branch circuit and the second feeding branch circuit of the antenna apparatus are disposed on the mainboard. This facilitates implementation of this application.

In an implementation, the terminal further includes a metal frame. At least a part of a radiator of the antenna apparatus is configured as the metal frame, and the first feeding branch circuit and the second feeding branch circuit each are electrically connected to the metal frame.

In an implementation, the terminal includes a USB interface. The metal frame is configured as a frame on a side of the USB interface.

According to the foregoing disposing, there is no other metal shielding for the antenna apparatus, so that the antenna apparatus does not need to consider clearance.

In an implementation, the first feeding branch circuit and the second feeding branch circuit are respectively disposed on two sides of the USB interface.

According to the foregoing disposing, the antenna apparatus is symmetrically disposed relative to the USB interface, so that a structure is simple.

In an implementation, the first feeding branch circuit and the second feeding branch circuit are disposed on a same side of the USB interface.

According to the foregoing disposing, space is reserved for arranging another component, and a structure is more flexible.

BRIEF DESCRIPTION OF DRAWINGS

To describe the technical solutions in the embodiments of the present invention or in the background more clearly, the following briefly describes the accompanying drawings required for describing the embodiments of the present invention or the background.

FIG. 1-2 is a schematic structural diagram of an equivalent antenna of the antenna apparatus in FIG. 1-1;

FIG. 1-3 is a schematic structural diagram of another equivalent antenna of the antenna apparatus in FIG. 1-1;

FIG. 1-4 is a schematic diagram of a circuit structure of an implementation of the antenna apparatus in FIG. 1-1;

FIG. 1-5 is a schematic diagram of area partition of a radiator of an antenna apparatus in an implementation of FIG. 1-1:

FIG. 1-6 is a schematic diagram of area partition of a radiator of an antenna apparatus in another implementation of FIG. 1-1:

FIG. 1-7 is a schematic diagram of S11 (input return loss) of the antenna apparatus in FIG. 1-1:

FIG. 1-8 is a schematic diagram of basic current distribution of the antenna apparatus that is in FIG. 1-1 and that is in a 0.5λ resonance mode;

FIG. 1-9 is a schematic diagram of basic current distribution of the antenna apparatus that is in FIG. 1-1 and that is in a 0.5λ resonance mode generated by matching;

FIG. 1-10 is a schematic diagram of basic current distribution of the antenna apparatus that is in FIG. 1-1 and that is in a 1λ resonance mode;

FIG. 1-11 is a schematic diagram of basic current distribution of the antenna apparatus that is in FIG. 1-1 and that is in a 1.5λ resonance mode;

FIG. 1-12 is a schematic diagram of basic current distribution of the antenna apparatus that is in FIG. 1-1 and that is in a 2.0λ resonance mode;

FIG. 1-13 is a schematic diagram of basic current distribution of the antenna apparatus that is in FIG. 1-1 and that is in a 2.5λ resonance mode;

FIG. 1-14 is a partial schematic structural diagram of a terminal in which the antenna apparatus in an implementation of FIG. 1-1 is disposed;

FIG. 1-15 is a schematic plan diagram of FIG. 1-14:

FIG. 1-16 is a partial schematic structural diagram of a terminal in which the antenna apparatus in another implementation of FIG. 1-1 is disposed;

FIG. 1-17 is a schematic plan diagram of FIG. 1-16;

FIG. 1-18 is a schematic diagram of S11 (input return loss) of an antenna apparatus provided in an implementation of this application;

FIG. 2-1 is a schematic structural diagram of an antenna apparatus according to a second embodiment of this application:

FIG. 2-2 is a schematic diagram of S11 (input return loss) of the antenna apparatus in FIG. 2-1;

FIG. 3-1 is a schematic structural diagram of an antenna apparatus according to a third embodiment of this application:

FIG. 4-1 is a schematic diagram of a circuit structure of an antenna apparatus according to a fourth embodiment of this application:

FIG. 4-2 is a schematic diagram of S11 (input return loss) of the antenna apparatus shown in FIG. 4-1;

FIG. 5-1 is a schematic diagram of a circuit structure of an antenna apparatus according to a fifth embodiment of this application; and FIG. 5-2 is a schematic diagram of S11 (input return loss) of the antenna apparatus shown in FIG. 5-1.

DESCRIPTION OF EMBODIMENTS

To make the objectives, technical solutions, and advantages of the embodiments of this application clearer, the following clearly and completely describes the technical solutions in the embodiments of this application with reference to the accompanying drawings in the embodiments of this application. Apparently, the described embodiments are merely a part rather than all of the embodiments of this application. All other embodiments obtained by a person of ordinary skill in the art based on the embodiments of this application without creative efforts shall fall within the protection scope of this application.

This application relates to an antenna apparatus that is applied in a terminal. The terminal may be a mobile phone, a tablet, a home gateway, or the like. The antenna apparatus is a loop antenna (loop antenna). The antenna apparatus may be applied in a GSM antenna, an LTE antenna, a WCDMA antenna, and the like, or may be applied in a GPS frequency band, a Wi-Fi frequency band, a 5G frequency band, a WIMAX frequency band, and the like.

Figure 1:
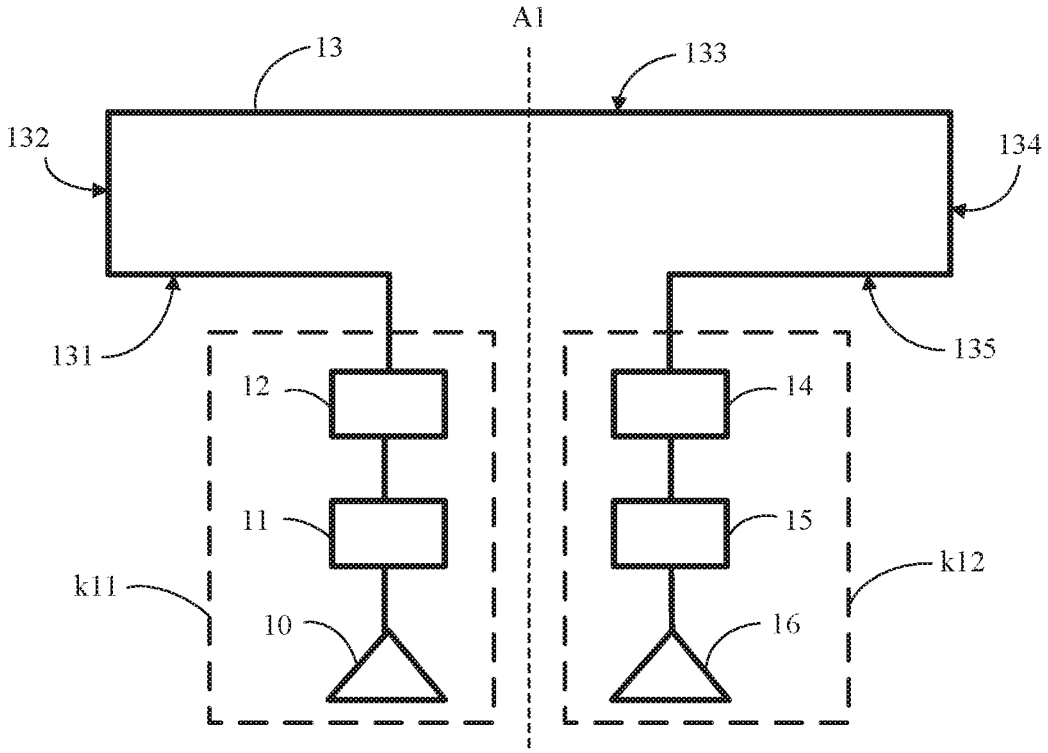
FIG. 1-1 is a schematic structural diagram of an antenna apparatus according to a first embodiment of this application.

FIG. 1-1 is a schematic structural diagram of an antenna apparatus according to a first embodiment of this application. The antenna apparatus includes a first feeding branch circuit k11, a second feeding branch circuit k12, and a radiator 13 connected between the first feeding branch circuit k11 and the second feeding branch circuit k12. The first feeding branch circuit k11 includes a first feedpoint 10 and a first filter circuit 12 electrically connected between the first feedpoint 10 and the radiator 13. The first feedpoint 10 is configured to feed a signal of a first frequency band. In an implementation, the first feeding branch circuit k11 further includes a first matching circuit 11. The first matching circuit 11 is electrically connected between the first feedpoint 10 and the first filter circuit 12. The first matching circuit 11 is configured to adjust an impedance of the antenna apparatus, so that radiation of the antenna apparatus to the signal of the first frequency band is resonated. In another implementation, the first matching circuit 11 may alternatively be integrated into the first filter circuit 12. The second feeding branch circuit k12 includes a second feedpoint 16 and a second filter circuit 14 electrically connected between the second feedpoint 16 and the radiator 13. The second feedpoint 16 is configured to feed a signal of a second frequency band. In an implementation, the second feeding branch circuit k11 further includes a second matching circuit 15. The second matching circuit 15 is electrically connected between the second feedpoint 16 and the second filter circuit 14. The second matching circuit 15 is configured to adjust the impedance of the antenna apparatus, so that radiation of the antenna apparatus to the signal of the second frequency band is resonated. In another implementation, the second matching circuit 15 may alternatively be integrated into the second filter circuit 14. The first filter circuit 12 is configured to: allow the signal of the first frequency band to pass through, and ground the signal of the second frequency band. The second filter circuit 14 is configured to: allow the signal of the second frequency band to pass through, and ground the signal of the first frequency band. Frequencies of the first frequency band and the second frequency band are different. For example, the first frequency band is a low frequency, and the second frequency is a high frequency.

In an implementation, the radiator 13 includes a first end and a second end. The first end of the radiator 13 is electrically connected to the first feeding branch circuit k11, and the second end of the radiator 13 is electrically connected to the second feeding branch circuit k12. Specifically, the first end of the radiator 13 is electrically connected to the first filter circuit 12, and the second end of the radiator 13 is electrically connected to the second filter circuit 14. A coupling loop antenna architecture is formed by connecting the radiator 13 to the first feeding branch circuit k11 and the second feeding branch circuit k12.

Figures 1, 2:
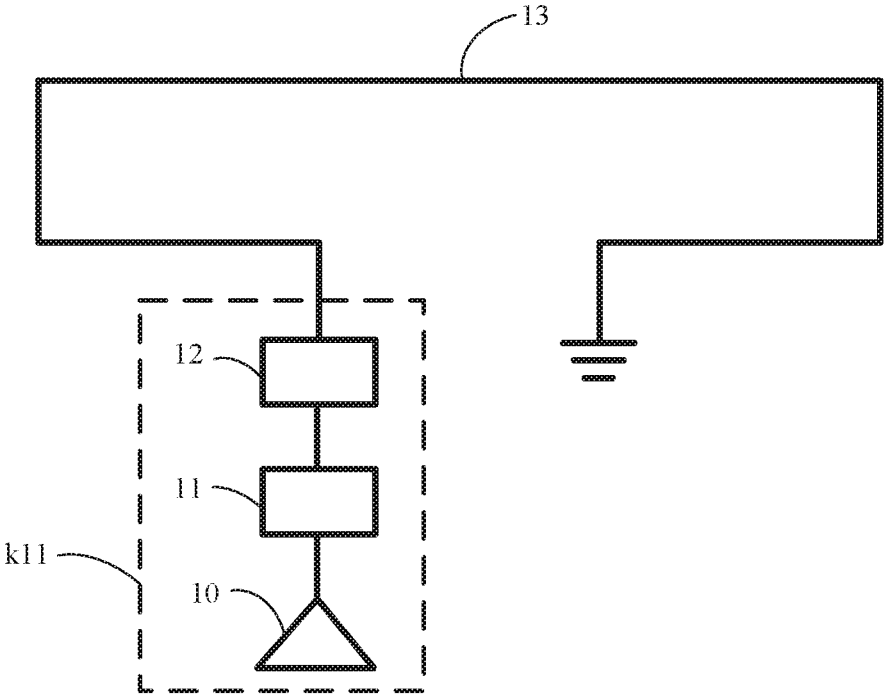
Figures 1, 2, 3:
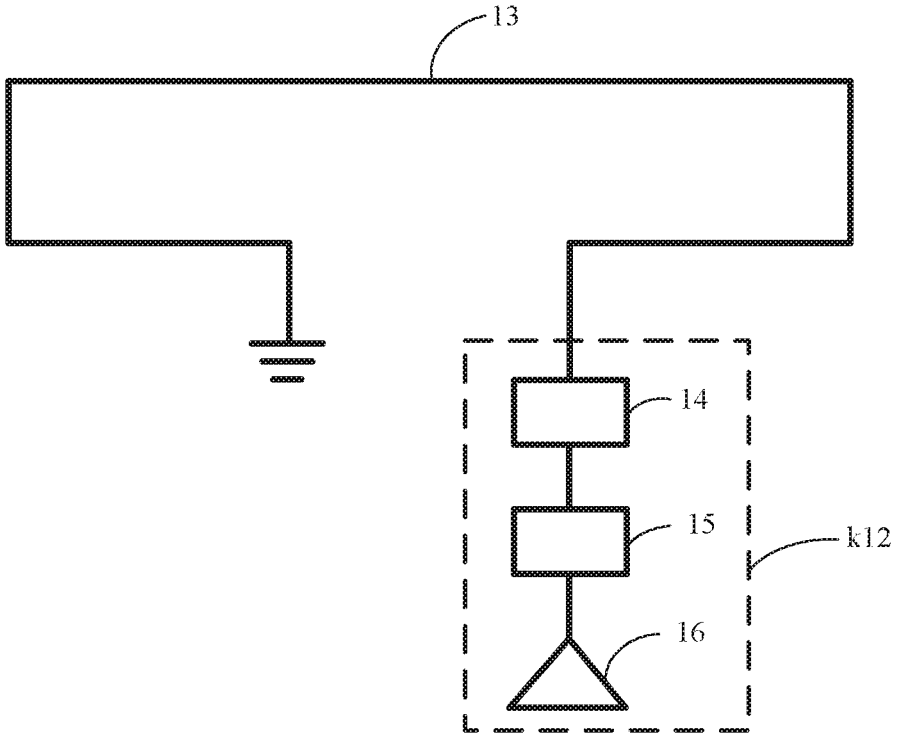

Because the first filter circuit 12 and the second filter circuit 14 are disposed, the signal that is of the first frequency band and that is fed by the first feedpoint 10 can pass through the first filter circuit 12, and the first filter circuit 12 hinders the signal that is of the second frequency band and that is fed by the second feedpoint 16 from passing through, and grounds the signal of the second frequency band; and the signal that is of the second frequency band and that is fed by the second feedpoint 16 can pass through the second filter circuit 14, and the second filter circuit 14 hinders the signal that is of the first frequency band and that is fed by the first feedpoint 10 from passing through, and grounds the signal of the first frequency band. In this way, it is equivalent to that the antenna apparatus in this application implements, on one radiator 13, functions of equivalent antennas in two frequency band range, so that the antenna apparatus has a good matching status, has multi-frequency performance, extends antenna bandwidth, and can be applied in a multi-frequency terminal. FIG. 1-2 is a schematic structural diagram of an equivalent antenna of the antenna apparatus in FIG. 1-1. FIG. 1-3 is a schematic structural diagram of another equivalent antenna of the antenna apparatus in FIG. 1-1. Referring to FIG. 1-1 and FIG. 1-2, the first feedpoint 10 of the first feeding branch circuit k11 feeds the signal of the first frequency band. The signal of the first frequency band can pass through the first filter 12 after being matched by using the first matching circuit 11, but cannot pass through the second filter 14. The second filter 14 grounds the signal of the first frequency band, and the first feedpoint 10 feeds a radio frequency signal to excite the radiator 13, so that the radiator 13 generates an electromagnetic wave radiated to surrounding space. In this way, an antenna function of transmitting the signal of the first frequency band is implemented. Referring to FIG. 1-1 and FIG. 1-3, the second feedpoint 16 of the second feeding branch circuit k12 feeds the signal of the second frequency band. The signal of the second frequency band can pass through the second filter 14 after being matched by using the second matching circuit 15, but cannot pass through the first filter 12. The first filter 12 grounds the signal of the second frequency band, and the second feedpoint 16 feeds a radio frequency signal to excite the radiator 13, so that the radiator 13 generates an electromagnetic wave radiated to the surrounding space. In this way, an antenna function of transmitting the signal of the second frequency band is implemented.

The first matching circuit 11 and the second matching circuit 15 are disposed, so that the signal of the first frequency band and the signal of the second frequency band match by using different matching circuits. In this way, interference between a high frequency signal and a low frequency signal may not be caused, antenna bandwidth can be extended, and multi-frequency performance is implemented.

In an implementation, the first feeding branch circuit k11 and the second feeding branch circuit k12 are symmetrically disposed on two sides of a centerline. Specifically, referring to FIG. 1-1, a centerline A1 is set. Alternatively, a location of the centerline A1 may be adjusted according to a different specific implementation of the antenna apparatus. The first feeding branch circuit k11 and the second feeding branch circuit k12 are symmetrically disposed along the centerline A1, so that locations at which the first feeding branch circuit k11 and the second feeding branch circuit k12 are accommodated are designed on the terminal. In addition, lengths of feeders that electrically connect a chip of the terminal (which is not shown in the figure) to the first feeding branch circuit k11 and the second feeding branch circuit k12 may be determined in advance, and in this way, impedance matching of the antenna apparatus may be adjusted.

FIG. 1-4 is a schematic diagram of a circuit structure of the antenna apparatus. The first feeding branch circuit k11 includes a first inductor 111, a second inductor 112, a third inductor 113, a first capacitor 121, and a second capacitor 122. The second inductor 112 is connected in series between the first feedpoint 10 and a ground. The first inductor 111 and the third inductor 113 are successively connected in series between the ground and an end that is of the second inductor 112 and that is far away from the ground. The first capacitor 121 and the second capacitor 122 are successively connected in series between the ground and an end that is of the third inductor 113 and that is far away from the ground. The radiator 13 is electrically connected to an end that is of the second capacitor 122 and that is far away from the ground. The first inductor 111, the second inductor 112, and the third inductor 113 form the first matching circuit 11, and the first capacitor 121 and the second capacitor 122 form the first filter circuit 12.

Further, the second feeding branch circuit k12 includes a third capacitor 151, a fourth capacitor 141, a fourth inductor 142, and a fifth inductor 143. The third capacitor 151 is connected in series between the second feedpoint 16 and the ground. The fourth inductor 142 is connected in series between the ground and an end that is of the third capacitor 151 and that is far away from the ground. The fourth capacitor 141 and the fifth inductor 143 are successively connected in series between the ground and an end that is of the fourth inductor 142 and that is far away from the ground. The third capacitor 151 forms the second matching circuit 15, and the fourth inductor 142, the fourth capacitor 141, and the fifth inductor 143 form the second filter circuit 14.

A circuit principle in FIG. 1-4 is as follows: Because an alternating current signal has a magnitude-phase characteristic, and a capacitor and an inductor have different frequency response characteristics at different frequencies, a frequency of the current signal that is of the first frequency band and that is fed by the first feedpoint 10 is lower than a frequency of the current signal that is of the second frequency band and that is fed by the second feedpoint 16. The first inductor 111 and the first capacitor 121 may allow the signal that is of the first frequency band and whose frequency is lower to pass through, and after resonance is generated on the radiator 13, a current is grounded after flowing through the fourth capacitor 141 and the third capacitor 151. In this case, an effect of the equivalent antenna of the antenna apparatus shown in FIG. 1-2 forms. The second feedpoint 16 feeds the current signal of the second frequency band. The fourth capacitor 141 may allow the signal that is of the second frequency band and whose frequency is higher to pass through, and after resonance is generated on the radiator 13, a current is grounded after flowing through the second capacitor 122. In this case, an effect of the equivalent antenna of the antenna apparatus shown in FIG. 1-3 forms. To adjust a frequency range of the current signal to meet a requirement of the impedance matching, bypass capacitors and bypass inductors of the second inductor 112, the third inductor 113, the second capacitor 122, the third capacitor 151, the fourth inductor 142, and the fifth inductor 143 that are grounded need to be disposed, so as to adjust the impedance matching of the antenna apparatus to an ideal status.

Specific values of each capacitor and each inductor in FIG. 1-4 are not limited in this application. However, for better understanding, a preferred implementation is provided. As marked in FIG. 1-4, an inductance value of the first inductor 111 is 1 nH, an inductance value of the second inductor 112 is 6.8 nH, an inductance value of the third inductor 113 is 6.8 nH, a capacitance value of the first capacitor 121 is 22 pF, a capacitance value of the second capacitor 122 is 9 pF, a capacitance value of the third capacitor 151 is 1.5 pF, a capacitance value of the fourth capacitor 141 is 1.5 pF, an inductance value of the fourth inductor 142 is 3 nH, and an inductance value of the fifth inductor 143 is 2 nH.

In this embodiment, the first matching circuit 11 and the first filter circuit 12 of the first feeding branch circuit k11, and the second matching circuit 15 and the second filter circuit 14 of the second feeding branch circuit k12 may be formed by lumped parameter components. In another embodiment, the first matching circuit 11 and the first filter circuit 12 of the first feeding branch circuit k11, and the second matching circuit 15 and the second filter circuit 14 of the second feeding branch circuit k12 may alternatively be formed by integrated devices. In this way, structural complexity of the antenna apparatus is reduced. Ranges that can be selected for the lumped parameter element or the integrated component are as follows: a capacitance value ranges from 0.3 pF to 100 pF, and an inductance value ranges from 0.5 nH to 100 nH.

FIG. 1-5 is a schematic diagram of area partition of a radiator of an antenna apparatus in an implementation. In an implementation, the radiator 13 includes a first area B1, a second area B2, and a third area B3. The first area B1 and the third area B3 are disposed on two opposite sides of the second area B2. The first feeding branch circuit k11 and the second feeding branch circuit k12 are electrically connected to the second area B2.

Specifically, the first area B1, the second area B2, and the third area B3 of the radiator 13 extend sequentially, spacing between adjacent areas of the first area B1, the second area B2, and the third area B3 is equal, or there may be no spacing. The first feeding branch circuit k11 and the second feeding branch circuit k12 are electrically connected to the second area B2, so that a central feeding structure forms on the radiator 13 of the antenna apparatus. In this way, the radiator 13 may alternatively be of a symmetrical structure along the second area B2. The first feeding branch circuit k11 and the second feeding branch circuit k12 are symmetrical along the centerline A1, so that the centerline A1 passes through a center of the second area B2 of the radiator 13. In this case, the antenna apparatus is of a symmetrical structure along the centerline A1 in general, and the structure is simple and easy to implement.

FIG. 1-6 is a schematic diagram of area partition of the radiator of the antenna apparatus in another implementation. A structure in this implementation is basically the same as the structure in the implementation shown in FIG. 1-5, and a difference is that the first feeding branch circuit k11 and the second feeding branch circuit k12 are electrically connected to the first area B1.

Specifically, the first feeding branch circuit k11 and the second feeding branch circuit k12 are symmetrical along a first centerline A1, and the radiator 13 is symmetrical along a second centerline A2 of the second area B2. The first feeding branch circuit k11 and the second feeding branch circuit k12 are electrically connected to the first area B1, so that the first centerline A1 deviates from the second centerline A2, and the first centerline A1 and the second centerline A2 are not collinear. In this way, an offset feeding structure forms in the antenna apparatus, to be specific, the first feeding branch circuit k11 and the second feeding branch circuit k12 offset relatively to the radiator 13. This structure may be away from a location of a component when being arranged on the terminal, so that arrangement of the antenna apparatus is more flexible.

The radiator 13 may be in a ring shape. In this embodiment, the radiator 13 is in a shape similar to a parallelogram. Specifically, still referring to FIG. 1-1, the radiator 13 includes a first segment 131, a second segment 132, a third segment 133, a fourth segment 134, and a fifth segment 135 that are successively connected to each other. Extension directions of the first segment 131 and the fifth segment 135 are the same, extension directions of the first segment 131 and the third segment 133 are the same, and extension directions of the second segment 132 and the fourth segment 134 are the same. The first segment 131 is electrically connected to the first filter circuit 12, and the fifth segment 135 is electrically connected to the second filter circuit 14. Further, the extension direction of the first segment 131 is approximately perpendicular to the extension direction of the second segment 132, so that the radiator 13 is in a shape similar to a rectangle. In an embodiment, the first segment 131 and the fifth segment 135 are of an equal length, and along a perpendicular line of a midpoint of the third segment 133, the first segment 131 and the fifth segment 135 are axisymmetric, and the second segment 132 and the fourth segment 134 are axisymmetric. In another embodiment, a length of the first segment 13 is not equal to a length of the fifth segment 135, and the second segment 132 and the fourth segment 134 are axisymmetric along the perpendicular line of the midpoint of the third segment 133. According to the foregoing disposing, the structure of the antenna apparatus tends to be simplified, and radiation performance can be better implemented.

An electrical length of the radiator 13 is related to a wavelength of a signal. Specifically, the length of the radiator 13 is a sum of electrical lengths of the first segment 131, the second segment 132, the third segment 133, the fourth segment 134, and the fifth segment 135. When the first feedpoint 10 feeds the signal of the first frequency band or the second feedpoint 16 feeds the signal of the second frequency band, and the antenna apparatus reaches a matching status, a wavelength of an electromagnetic wave signal that forms a resonance frequency on the radiator 13 is k. Because the electrical length of the radiator 13 is determined, a plurality of resonance frequencies are generated on the radiator 13. Each of different resonance frequencies during resonance is referred to as a resonance mode, and the antenna apparatus has a plurality of different resonance modes.

For example, six basic antenna resonance modes may be excited in 0 GHz to 3 GHz frequency bands, and are a 0.5λ resonance mode, a 0.5λ resonance mode generated by matching, a 1λ resonance mode, a 1.5λ resonance mode, a 2.0λ resonance mode, and a 2.5λ resonance mode respectively. FIG. 1-7 is a schematic diagram of S11 of the antenna apparatus shown in FIG. 1-1. At a low frequency, a resonance frequency of the 0.5λ resonance mode is LB1, and a resonance frequency of the 0.5λ matching resonance mode is LB2; at an intermediate frequency, a resonance frequency of the 1λ resonance mode is MB1, and a resonance frequency of the 1.5λ resonance mode is MB2; and at a high frequency, a resonance frequency of the 2.0λ resonance mode is HB1, and a resonance frequency of the 2.5λ resonance mode is HB2. Frequencies of resonance frequency LB1, LB2, MB1, MB2, HB1, and HB2 of the 0.5λ resonance mode, the 0.5λ resonance mode generated by matching, the 1λ resonance mode, the 1.5λ resonance mode, the 2.0λ resonance mode, and the 2.5λ resonance mode increase successively. In this way, a multi-frequency function of the antenna is implemented.

FIG. 1-8 to FIG. 1-13 are schematic diagrams of basic current distribution of the six basic antenna resonance. Referring to FIG. 1-8, the first filter circuit 12 and the first matching circuit 11 are omitted in the figure, and FIG. 1-8 is a schematic diagram of basic current distribution of the antenna apparatus in the 0.5λ resonance mode. The first feedpoint 10 feeds the electromagnetic wave whose wavelength is λ to excite generation of resonance on the radiator 103, and a wavelength corresponding to the electromagnetic wave during the resonance is 0.5λ. When the resonance is generated, a current on the radiator 103 flows reversely along a specific point. A current reversal point in the figure means that: At a point on the radiator 103, because of an effect of mutual superposition of magnetic fields generated by two reverse currents, general magnetic field distributed in a vertical direction forms. A magnetic field distributed in a vertical direction has a higher magnetic field strength and better magnetic field uniformity than a magnetic field generated by a single dipole antenna. In other words, when current distribution of the radiator 13 presents a current reverse flow characteristic at the current reversal point, the antenna apparatus is in a resonance status. In the 0.5λ resonance mode, when the radiator 13 is completely symmetrical, the current reversal point is approximately located at the midpoint of the third segment 113 of the radiator 13, and a magnetic field generated on the radiator 13 is symmetrical along the current reversal point. Certainly, in an actual terminal product, the radiator 13 is not completely symmetrical, or the radiator 13 is not of a uniform size and has a different matching circuit, and in this case, a location of the current reversal point changes.

FIG. 1-9 is a schematic diagram of basic current distribution of the antenna apparatus in the 0.5λ resonance mode generated by matching. The first filter circuit 12 and the first matching circuit 11 are omitted in the figure. The 0.5λ resonance mode generated by matching is similar to the 0.5λ resonance mode shown in FIG. 1-8. However, a difference is that when an electromagnetic wave signal fed by the first feedpoint 10 excites the radiator 13, a delay effect of the electromagnetic wave signal is caused because an input impedance characteristic of the antenna is changed by adjusting matching, so that the location of the current reversal point is offset, and a resonance frequency of the 0.5λ resonance mode is greater than a resonance frequency of the 0.5% resonance mode. With reference to FIG. 1-7, the frequency LB1 of the resonance frequency of the 0.5λ resonance mode is closer to 0.7 GHz in a horizontal coordinate, and the frequency LB2 of the resonance frequency of the 0.5λ resonance mode generated by matching is closer to 0.96 GHz in the horizontal coordinate, and is greater than the frequency LB1 of the resonance frequency of the 0.5λ resonance mode.

FIG. 1-10 is a schematic diagram of basic current distribution of the antenna apparatus in the 1λ resonance mode. The second filter circuit 14 and the second matching circuit 15 are omitted in the figure. The 1λ resonance mode is similar to the 0.5λ resonance mode shown in FIG. 1-8. However, a difference is that the second feedpoint 16 feeds an electromagnetic wave signal whose wavelength is λ, a wavelength corresponding to the electromagnetic wave during resonance is 1λ, two current reversal points are generated when the radiator 13 is excited, and the two current reversal points are approximately located at midpoints of the second segment 112 and the fourth segment 114 of the radiator 13. With reference to FIG. 1-7, the frequency MB1 of a resonance frequency of the 1λ resonance mode is closer to 1.7 GHz in the horizontal coordinate, and is greater than the frequency LB2 of the resonance frequency of the 0.5λ resonance mode generated by matching.

FIG. 1-11 is a schematic diagram of basic current distribution of the antenna apparatus in the 1.5λ resonance mode. The second filter circuit 14 and the second matching circuit 15 are omitted in the figure. The 1.5λ resonance mode is similar to the 1λ resonance mode shown in FIG. 1-10. However, a difference is that the second feedpoint 16 feeds the electromagnetic wave signal whose wavelength is λ, a wavelength corresponding to the electromagnetic wave during resonance is 1.5λ, three current reversal points are generated when the radiator 13 is excited, and the three current reversal points are approximately located at midpoints of the first segment 131, the third segment 113, and the fifth segment 135 of the radiator 13. With reference to FIG. 1-7, the frequency MB2 of a resonance frequency of the 1.5λ resonance mode is closer to 2.2 GHz in the horizontal coordinate, and is greater than the frequency MB1 of the resonance frequency of the 1λ resonance mode.

FIG. 1-12 is a schematic diagram of basic current distribution of the antenna apparatus in the 2.0λ resonance mode. The second filter circuit 14 and the second matching circuit 15 are omitted in the figure. The 2.0λ resonance mode is similar to the 1λ resonance mode shown in FIG. 1-10. However, a difference is that the second feedpoint 16 feeds the electromagnetic wave signal whose wavelength is λ, a wavelength corresponding to the electromagnetic wave during resonance is 2.0λ, four current reversal points are generated when the radiator 13 is excited, the four current reversal points are approximately located at the first segment 131, the third segment 113, and the fifth segment 135 of the radiator 13, and extension lengths of the four current reversal points on the radiator 13 are approximately the same. With reference to FIG. 1-7, the frequency HB1 of a resonance frequency of the 2.0λ resonance mode is closer to 2.7 GHz in the horizontal coordinate, and is greater than the frequency MB2 of the resonance frequency of the 1.5λ resonance mode.

FIG. 1-13 is a schematic diagram of basic current distribution of the antenna apparatus in the 2.5λ resonance mode. The second filter circuit 14 and the second matching circuit 15 are omitted in the figure. The 2.5λ resonance mode is similar to the 1λ resonance mode shown in FIG. 1-10. However, a difference is that the second feedpoint 16 feeds the electromagnetic wave signal whose wavelength is λ, a wavelength corresponding to the electromagnetic wave during resonance is 2.5λ, five current reversal points are generated when the radiator 13 is excited, the five current reversal points are approximately located at the first segment 131, the second segment 112, the third segment 113, the fourth segment 114, and the fifth segment 135 of the radiator 13, and extension lengths of the five current reversal points on the radiator 13 are approximately the same. With reference to FIG. 1-7, the frequency HB2 of a resonance frequency of the 2.5λ resonance mode is closer to 3 GHz in the horizontal coordinate, and is greater than the frequency HB1 of the resonance frequency of the 2.0λ resonance mode.

FIG. 1-14 is a partial schematic structural diagram of a terminal in which the antenna apparatus in an implementation is disposed. The terminal includes a mother board 01 and a mainboard 02. The mainboard 02 is disposed above the mother board 01 in a stack manner, and a USB interface 021 is disposed on a side of the mainboard 02. The first feeding branch circuit k11 and the second feeding branch circuit k12 of the antenna apparatus are disposed on the mainboard 021. In addition, the first feeding branch circuit k11 is disposed on a left side of the USB interface 021, and the second feeding branch circuit k12 is disposed on a right side of the USB interface 021. The radiator 13 of the antenna apparatus is disposed on a side of the USB interface 021. Specifically, the first segment 131 is parallel to a plane on which the mainboard 02 is located and is disposed on the left side of the USB interface 021, and there is a distance between the first segment 131 and the plane on which the mainboard is located. The second segment 132 is approximately perpendicular to an extension direction of the first segment 131, and is approximately parallel to the plane on which the mainboard 02 is located. The third segment 133 is approximately perpendicular to an extension direction of the second segment 132, the second segment 132 is connected to one end of the third segment 133, and the third segment 133 is approximately perpendicular to the plane on which the mainboard 02 is located. The fourth segment 134 is approximately perpendicular to an extension direction of the third segment 133, and is approximately parallel to the plane on which the mainboard 02 is located, and the fourth segment 134 is connected to the other end opposite to the third segment 133. The fifth segment 135 is approximately perpendicular to an extension direction of the fourth segment 134, and is approximately parallel to the plane on which the mainboard 02 is located, the fifth segment 135 is located at the right side of the USB interface 021, and the fifth segment 135 and the first segment 131 are approximately located on a same plane. According to the disposing, the antenna apparatus is symmetrically disposed relative to the USB interface 021, so that a structure is simple.

Referring to FIG. 1-14 and FIG. 1-15, FIG. 1-15 is a schematic plane diagram of FIG. 1-14. A first contact 1313 is electrically connected to the first feeding branch circuit k11, and a second contact 1353 is electrically connected to the second feeding branch circuit k12. The first segment 131 of the radiator 13 is electrically connected to the first contact 1313, and the fifth segment 135 is electrically connected to the second contact 1353. Specifically, the first segment 131 may be electrically connected to the first contact 1313 by using a first spring plate 1312, and the fifth segment 135 may be electrically connected to the second contact 1353 by using a second spring plate 1352. Because the first segment 131 and the fifth segment 135 of the radiator 13 are higher than the plane on which the mainboard 02 is located, the first spring plate 1312 and the second spring plate 1312 may be disposed to be perpendicular to the plane on which the mainboard 02 is located. In this way, there is a sufficient distance between the radiator 13 and each of the first feeding branch circuit k11 and the second feeding branch circuit k12, so that radiation generated by current flows of the first feeding branch circuit k11 and the second feeding branch circuit k12 on the mainboard 02 does not interfere with a radiation characteristic of the radiator 13.

Because the USB interface 021 on the terminal needs to reserve space facing outside of the terminal, a first through-hole 1331 is disposed at a location that is of the third segment 133 of the radiator 13 and that is corresponding to the USB interface 021. In addition, because a headset, a microphone interface, or another interface needs to be disposed, a second through-hole 1332 is disposed on the third segment 133. To prevent a difference between the radiation characteristic of the radiator 13 and a radiation characteristic of a radiator 13 with a uniform structure from being very large, a first block 1311 is disposed on the first segment 131, and a second block 1351 is disposed on the fifth segment 135. The first block 1311 is equivalent to a protruded block that is of the first segment 131 and that is parallel to the plane on which the mainboard 02 is located, and the second block 1351 is equivalent to a protruded block that is of the fifth segment 135 and that is parallel to the plane on which the mainboard 02 is located. In addition, a protruded block 1314 is electrically connected to the first block 1311, and the protruded block 1314 is located on the same plane on which the mainboard 02 is located. A radiation characteristic of the antenna apparatus may be adjusted by disposing the first block 1311, the second square 1353, and the protruded block 1314.

FIG. 1-16 a partial schematic diagram of a terminal in which the antenna apparatus in another implementation is disposed. FIG. 1-17 is a schematic plane diagram of FIG. 1-16. A structure of the antenna apparatus disposed in the terminal in this implementation is basically the same as that in the previous implementation. A difference is that the first feeding branch circuit k11 and the second feeding branch circuit k12 are disposed on a same side of the USB interface 021. Because the terminal includes many components, to reserve space for arranging another component, the first feeding branch circuit k11 and the second feeding branch circuit k12 are disposed on the same side of the USB interface 021. In this way, the structure is more flexible.

Figures 1, 2, 3, 4:
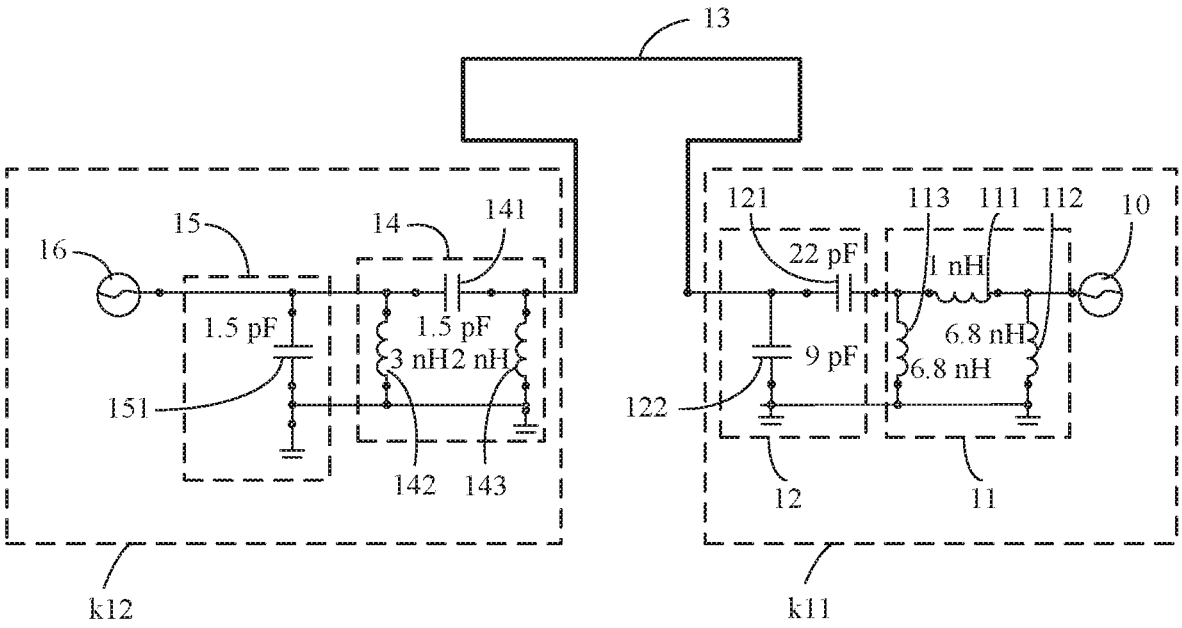

Similar to the antenna apparatus in the previous implementation, a block (a number 1351 in FIG. 4-2 and FIG. 4-3 is used as an example) for tuning is also disposed on the radiator 13 in this implementation, and the first through-hole 1331 is also disposed on the third segment 133 for exposing the USB interface 021. In addition, the second through-hole 1332 may be disposed based on a specific structure of the terminal for exposing another component such as a microphone interface.

In this embodiment, the third segment 133 of the radiator 13 may be configured as a metal frame of the terminal. Further, the metal frame may be configured as a frame on a side of the USB interface. In this case, there is no other metal shielding, so that the antenna apparatus does not need to consider clearance. In another embodiment, the third segment 133 of the radiator 13 may be alternatively configured inside the terminal. In this case, a clearance area needs to be left on the terminal, to avoid metal shielding. For example, a manner in which a housing of the terminal is configured as a non-metal material, a manner in which a metal housing of the terminal is slit, or the like may be used.

FIG. 1-18 is a schematic diagram of S11 (input return loss) of the antenna apparatus in an implementation. There are six low points on input return loss curves in the figure of S11, and the six low points are respectively corresponding to resonance frequencies of six resonance. This indicates that in this embodiment of this application, bandwidth of the antenna apparatus is wide enough, and the radiation characteristic meets a multi-frequency requirement.

FIG. 2-1 is a schematic structural diagram of an antenna apparatus according to a second embodiment of this application. Referring to FIG. 2-1, the antenna apparatus is basically the same as an antenna apparatus in the first embodiment. However, a difference is that the antenna apparatus further includes a first switch 17 and at least one ground branch 171. The at least one ground branch 171 is connected in parallel between the first switch 17 and a ground. The first switch 17 is electrically connected to the radiator 13 and is disposed on a side of the radiator that is close to the second feeding branch circuit k12. The first switch 17 cooperates with the at least one ground branch 171 to switch an electrical length of a signal of the first frequency band. In an implementation, there is one ground branch 171. In another implementation, there are at least two ground branches 171.

Specifically, one end of the first switch 17 is electrically connected to a fifth segment 135 of the radiator 13, and the other end is grounded. Further, an impedance component 172 is connected in series between the at least one ground branch 171 and the ground. The impedance component 172 may include a resistor, an inductor, or a capacitor. For example, when the first switch 17 is in a turn-off status, the antenna apparatus in this embodiment is the same as the antenna apparatus in the first embodiment. When the first switch 17 is connected to an impedance component 172 to which an inductor is connected in series, because the inductor has a characteristic of allowing a low frequency signal to pass through and hindering a high frequency signal, a low frequency signal that is of the first frequency band and that is fed by a first feedpoint 10 is directly grounded at the first switch 17, so that a physical electrical length of the radiator 13 of the antenna apparatus is shortened, to be specific, a part that is of the radiator 13 and that is configured to radiate a signal lacks a segment that is on the fifth segment 135 and that is from a point electrically connected to the first switch 17 to the second feeding branch circuit k12. In this case, a frequency at which the signal of the first frequency band generates resonance moves toward a high frequency. When the first switch 17 is connected to a 0-ohm impedance component 172, relative to that the first frequency band is directly grounded at the first switch 17, the physical electrical length of the radiator 13 is the shortest, and the frequency at which the first frequency band generates the resonance is the highest. Bandwidth of the first frequency band may be extended by disposing the first switch 17, the ground branch 171, and the impedance component 172.

FIG. 2-2 is a schematic diagram of S11 (input return loss) of the antenna apparatus in this embodiment. When the first switch 17 is connected to different impedance components, it can be seen that a low resonance frequency changes obviously. In this way, the antenna apparatus in this embodiment can implement multi-frequency performance, and can adjust the low resonance frequency.

FIG. 3-1 is a schematic structural diagram of an antenna apparatus according to a third embodiment of this application. The antenna apparatus is basically the same as an antenna apparatus in the first embodiment. However, a difference is that the antenna apparatus further includes a radiation branch 20, a second switch 18, a first ground branch 181, and at least one second ground branch 182. The first ground branch 181 is connected in series between the second switch 18 and the second feeding branch circuit k12. The at least one second ground branch 182 is connected in parallel between the second switch 18 and a ground. The radiation branch 18 is electrically connected to an end that is of the second feeding branch circuit k12 and that is connected to the first ground branch 181. There may be one second ground branch 181, or there may be at least two second ground branches 181.

Specifically, one end of the second switch 18 is electrically connected to a fifth segment 135 of a radiator 13. Impedance components 183 may be electrically connected to the first ground branch 181 and the at least one second ground branch 182 respectively. The impedance component 183 may include a resistor, an inductor, or a capacitor. The first ground branch 181 is electrically connected to a second filter circuit 14 of the second feeding branch circuit k12 by using one impedance component 183. The at least one second ground branch 182 is electrically connected to the ground by using another impedance component 183. A function of the impedance component 183 is to adjust a physical electrical length of the radiator 13.

An operating principle of the antenna apparatus in this embodiment is as follows: When the second switch 18 is connected to the first ground branch 181, a signal that is of a first frequency band and that is fed by a first feeding branch circuit k11 is radiated on the radiator 13, and then is grounded at the second filter circuit 14; and a signal that is of a second frequency band and that is fed by the second feeding branch circuit k12 is radiated on the radiator 13 and the radiation branch 20, and then, some of signals on the radiator 13 are grounded at a first filter circuit 12. In this case, compared with the first embodiment, a radiation characteristic of the signal of the second frequency band changes. When the second switch 18 is connected to and is grounded at the second ground branch 182, it is equivalent to that a circuit between the radiator 13 and the second feeding branch circuit k12 is broken, and the signal that is of the first frequency band and that is fed by the first feeding branch circuit k11 is radiated on the radiator 13, and then is grounded at the second switch 18 by using the second ground branch; and the signal that is of the second frequency band and that is fed by the second feeding branch circuit k12 is radiated on the radiation branch 20.

According to the foregoing disposing, the second switch 18 cooperates with the first ground branch 181 or the at least one second ground branch 182, so that a plurality of operating modes of the antenna apparatus can be implemented. In this way, the antenna apparatus has multi-frequency performance, and resonance frequencies of a high frequency signal and a low frequency signal can be adjusted.

In an implementation, the radiation branch 20 is disposed to be separated from the radiator 13, and a physical electrical length of the radiation branch 20 is less than the physical electrical length of the radiator 13. Specifically, a frequency of the first frequency band is lower than a frequency of the second frequency band. The radiation branch 20 is configured to radiate a signal of a resonance frequency in the second frequency band, and a higher frequency indicates a shorter wavelength, and requires a shorter physical antenna length. The radiator 13 is configured to radiate not only the signal whose resonance frequency is in the second frequency band but also a signal whose resonance frequency is in the first frequency band. Therefore, the physical electrical length of the radiation branch 20 is disposed to be less than the physical electrical length of the radiator 13, so that a requirement of radiating the signal of the second frequency band can be met. To avoid mutual radiation interference, the radiation branch 20 needs to be separated from the radiator 13 by a specific distance, to ensure sufficient antenna isolation.

FIG. 4-1 is a schematic diagram of a circuit structure of an antenna apparatus according to a fourth embodiment of this application. The first feeding branch circuit k11 includes a first capacitor 114, a second capacitor 116, a third capacitor 126, a first inductor 115, a second inductor 117, a third inductor 124, and a fourth inductor 125. The second capacitor 116 is connected in series between the second feedpoint 10 and a ground. The second inductor 117 is connected in series between the ground and an end that is of the second capacitor 116 and that is far away from the ground. The first capacitor 114, the first inductor 115, and the third inductor 124 are successively connected in series between the ground and an end that is of the second inductor 117 and that is far away from the ground. The fourth inductor 125 and the third inductor 126 are successively connected in series between the ground and an end that is of the third capacitor 124 and that is far away from the ground. The radiator 13 is electrically connected to an end that is of the fourth inductor 125 and that is far away from the ground. The first capacitor 114, the second capacitor 116, the first inductor 115 and the second inductor 117 form the first matching circuit 11, and the third capacitor 126, the third inductor 124, and the fourth inductor 125 form the first filter circuit 12.

Further, the second feeding branch circuit k12 includes a fourth capacitor 152, a fifth capacitor 145, a fifth inductor 153, a sixth inductor 144, and a seventh inductor 146. The fifth inductor 153 is connected in series between the second feedpoint 16 and the ground. The fourth capacitor 152, the fifth capacitor 145, and the seventh inductor 146 are successively connected in series between the ground and an end that is of the fifth inductor 153 and that is far away from the ground. The sixth inductor 144 is connected in parallel to two ends of the fifth capacitor 145. The radiator 13 is electrically connected to an end that is of the seventh inductor 146 and that is far away from the ground. The fourth capacitor 152 and the fifth inductor 153 form the second matching circuit 15, and the fifth capacitor 145, the sixth inductor 144, and the seventh inductor 146 form the second filter circuit 14.

A circuit principle in FIG. 4-1 is as follows: Because an alternating current signal has a magnitude-phase characteristic, and a capacitor and an inductor have different frequency response characteristics at different frequencies, a frequency of a current signal that is of a first frequency band and that is fed by the first feedpoint 10 is lower than a frequency of a current signal that is of a second frequency band and that is fed by the second feedpoint 16. The first capacitor 113 and the first inductor 114 may allow the signal that is of the first frequency band and whose frequency is lower to pass through, and after resonance is generated on the radiator 13, the current signal is grounded at the seventh inductor 146 because the sixth inductor 144 and the fifth capacitor 145 that are connected in parallel hinder a low frequency signal and an intermediate frequency signal. The second feedpoint 16 feeds the current signal of the second frequency band. The fourth capacitor 152 may allow the signal that is of the second frequency band and whose frequency is higher to pass through. At the sixth inductor 144 and the fifth capacitor 145 that are connected in parallel, a high frequency part of the current signal passes through the sixth inductor 144, and a super high frequency part passes through the fifth capacitor 145. After resonance is generated on the radiator 13, the current signal is grounded at the first filter circuit 12 or the first matching circuit 11. To adjust impedance matching of the antenna, bypass capacitors and bypass inductors of the second capacitor 116, the second inductor 117, the third inductor 124, the fourth inductor 125, the third capacitor 126, the fifth inductor 153, and the seventh inductor 146 that are grounded need to be disposed, so as to adjust impedance matching of the antenna apparatus to an ideal status.

The sixth inductor 144 and the fifth capacitor 145 that are connected in parallel are equivalent to a band-stop filter component added to the second filter 14, so that a resonance frequency of the antenna apparatus includes a low frequency part and an intermediate frequency part. This is equivalent to that a low frequency signal of a first frequency band and an intermediate frequency signal of a second frequency band of an antenna apparatus in the first embodiment cannot pass through, and in the second frequency band, a high frequency part is further separated from a super high frequency part. Therefore, antenna bandwidth is extended.

Specific values of each capacitor and each inductor in FIG. 4-1 are not limited in this application. However, for better understanding, a preferred implementation is provided. As marked in FIG. 4-1, a capacitance value of the first capacitor 114 is 2.2 pF, an inductance value of the first inductor 115 is 6.8 nH, a capacitance value of the second capacitor 116 is 2.5 pF, an inductance value of the second inductor 117 is 5.3 nH, an inductance value of the third inductor 124 is 5 nH, an inductance value of the fourth inductor 125 is 6 nH, a capacitance value of the third capacitor 126 is 0.65 pF, a capacitance value of the fourth capacitor 152 is 1.8 pF, an inductance value of the fifth inductor 153 is 0.8 nH, an inductance value of the sixth inductor 144 is 2.5 nH, a capacitance value of the fifth capacitor 145 is 3.3 pF, and an inductance value of the seventh inductor 146 is 2.7 nH.

FIG. 4-2 is a schematic diagram of S11 (input return loss) of the antenna apparatus shown in FIG. 4-1. It can be seen that the antenna apparatus includes two low resonance frequencies, two intermediate resonance frequencies, one high resonance frequency, and one super high resonance frequency. In this way, performance of the antenna apparatus meets a multi-frequency requirement.

Figures 1, 2, 3, 4, 5:
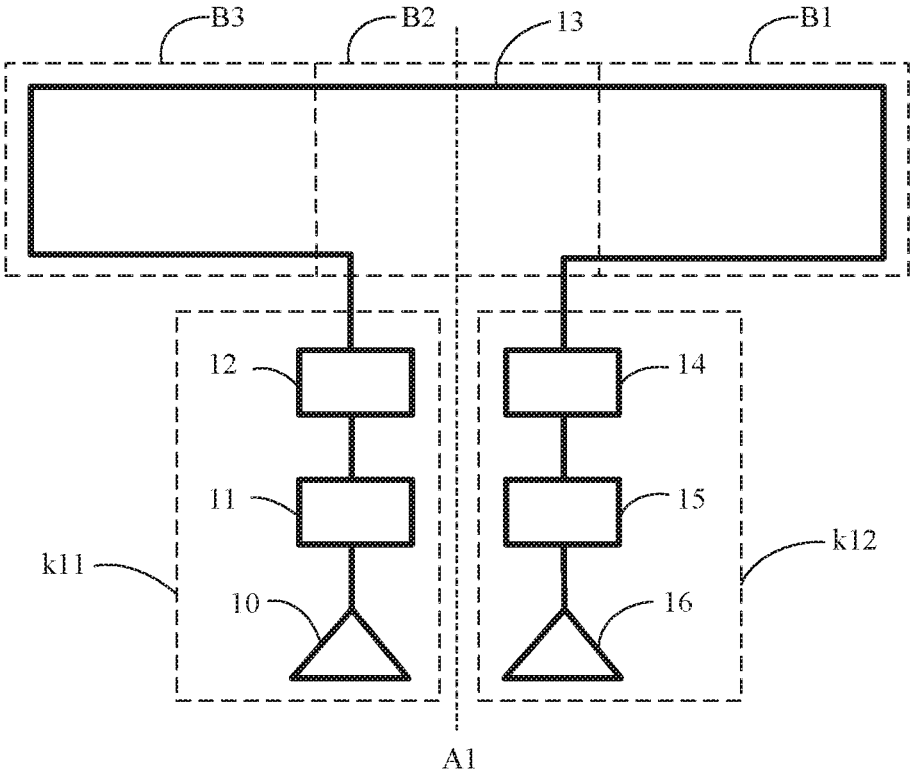
Figures 1, 2, 3, 4, 5, 6:
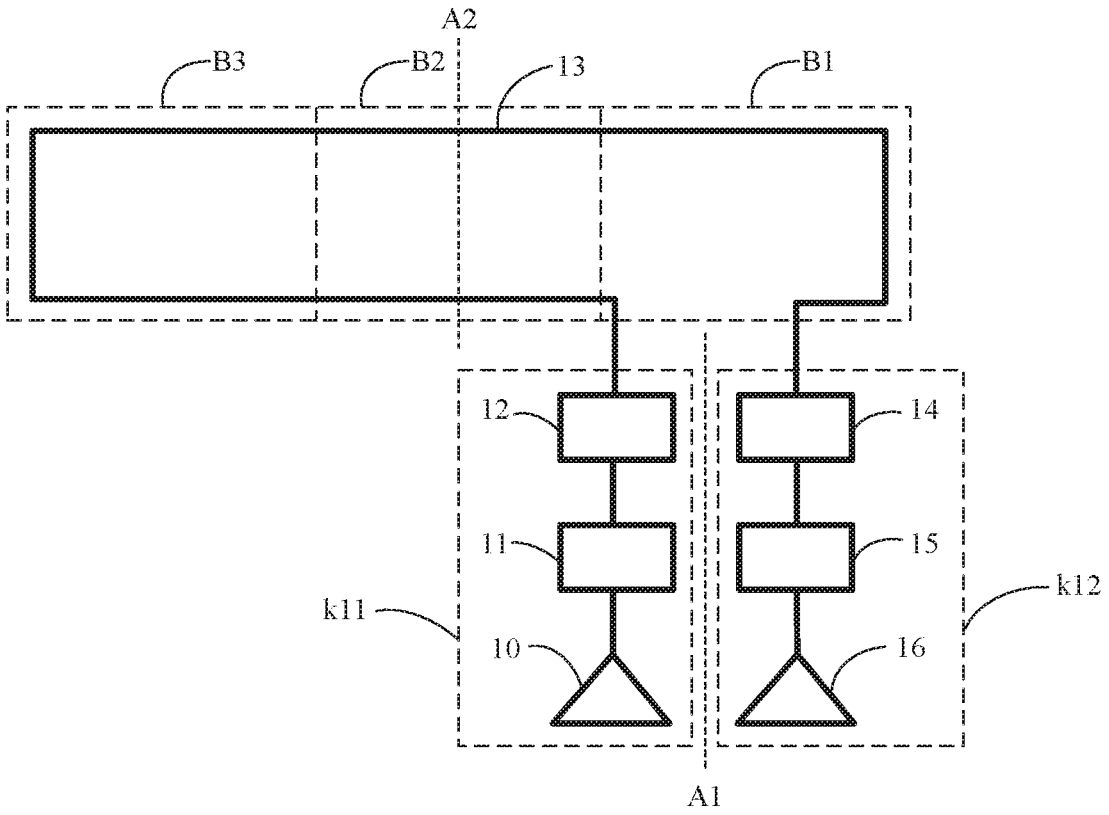
Figures 1, 2, 3, 4, 5, 6, 7:
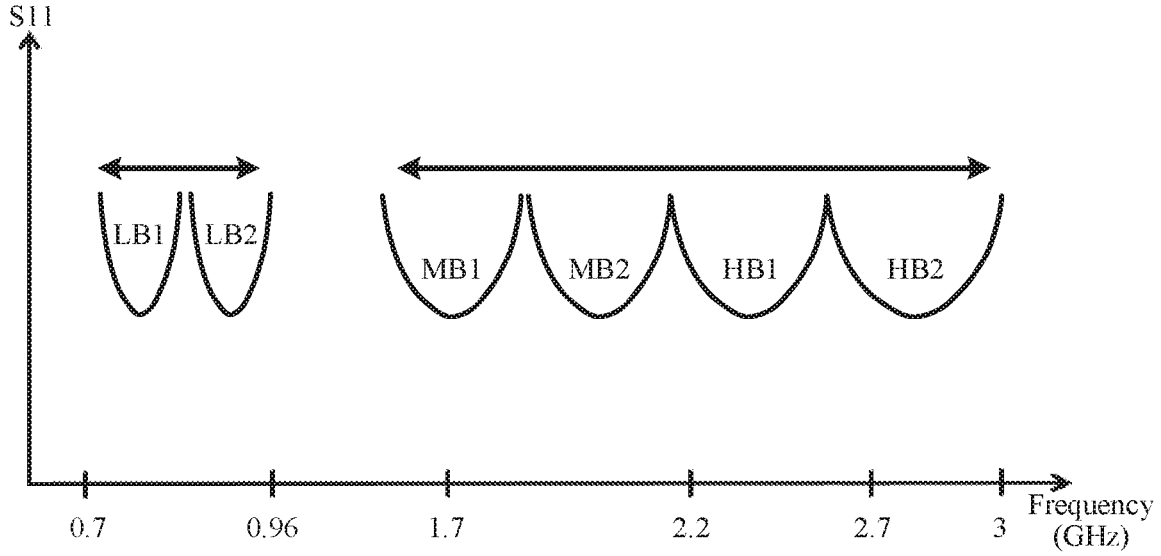
Figures 1, 2, 3, 4, 5, 6, 7, 8:
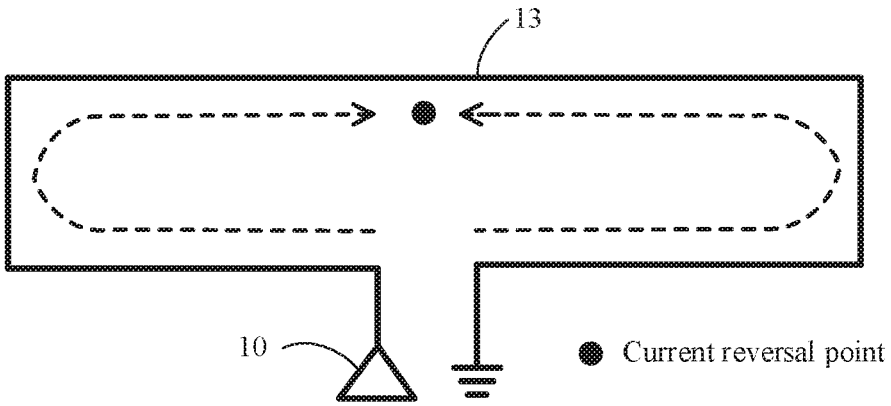
Figures 1, 2, 3, 4, 5, 6, 7, 8, 9:
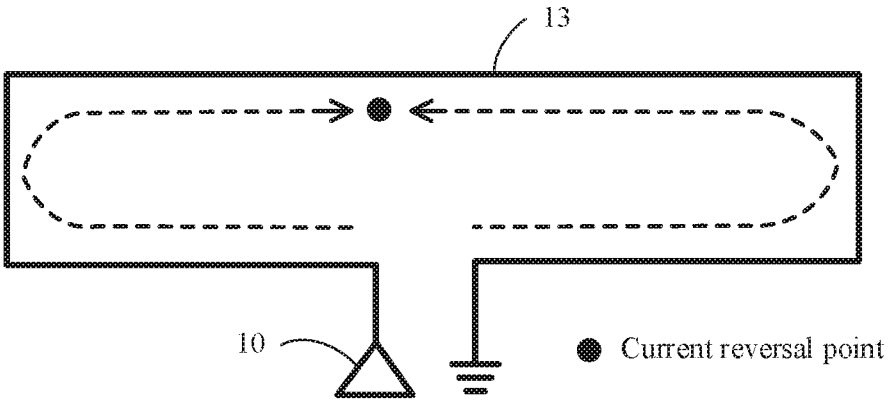
Figures 1, 2, 3, 4, 5, 6, 7, 8, 9, 10:
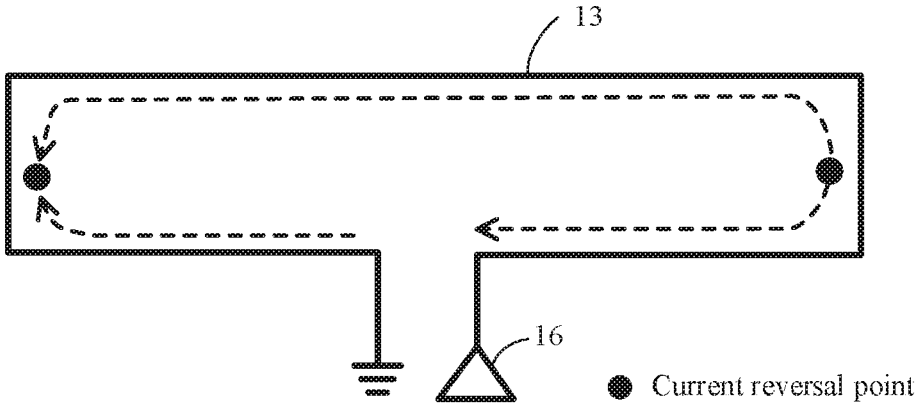
Figures 1, 2, 3, 4, 5, 6, 7, 8, 9, 10, 11:
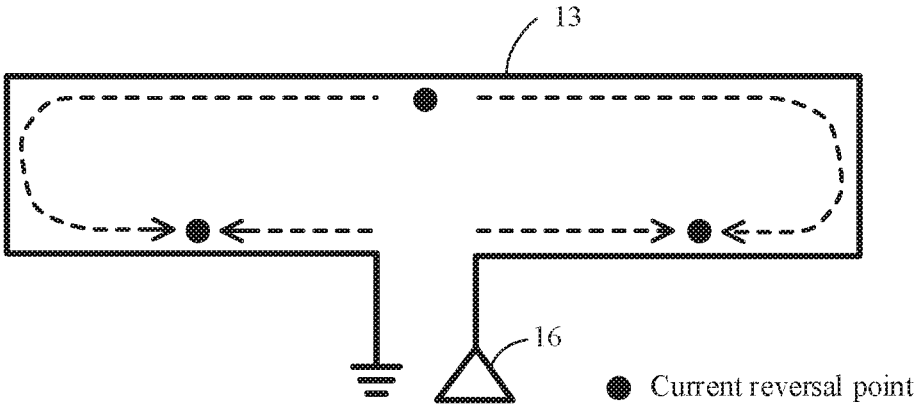
Figures 1, 2, 3, 4, 5, 6, 7, 8, 9, 10, 11, 12:
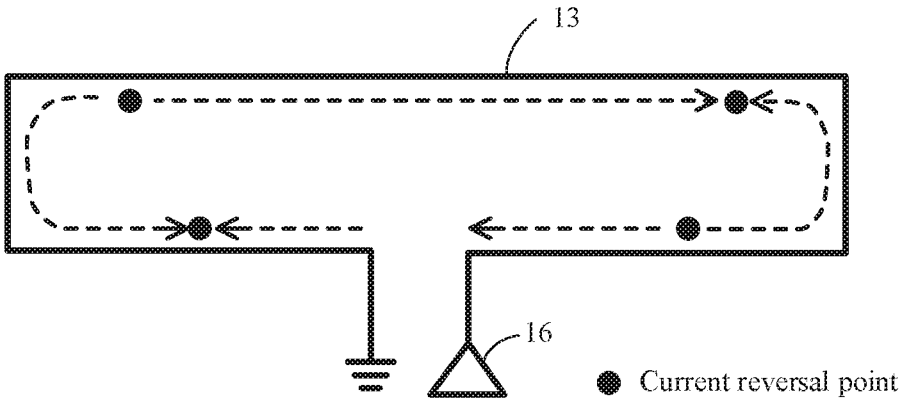
Figures 1, 2, 3, 4, 5, 6, 7, 8, 9, 10, 11, 12, 13:
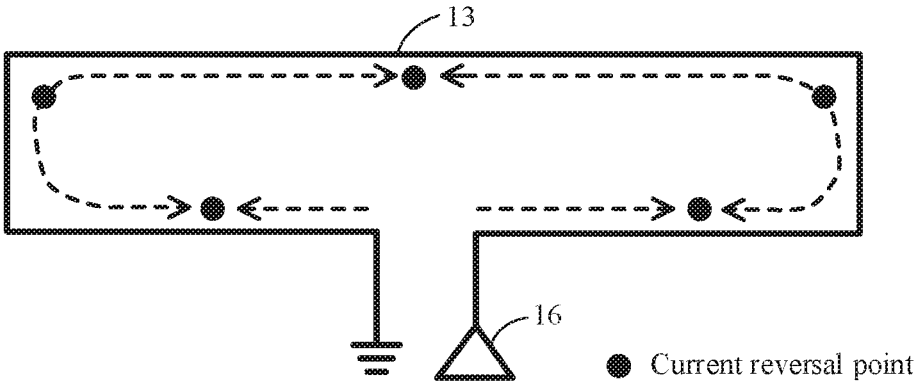
Figures 1, 2, 3, 4, 5, 6, 7, 8, 9, 10, 11, 12, 13, 14:
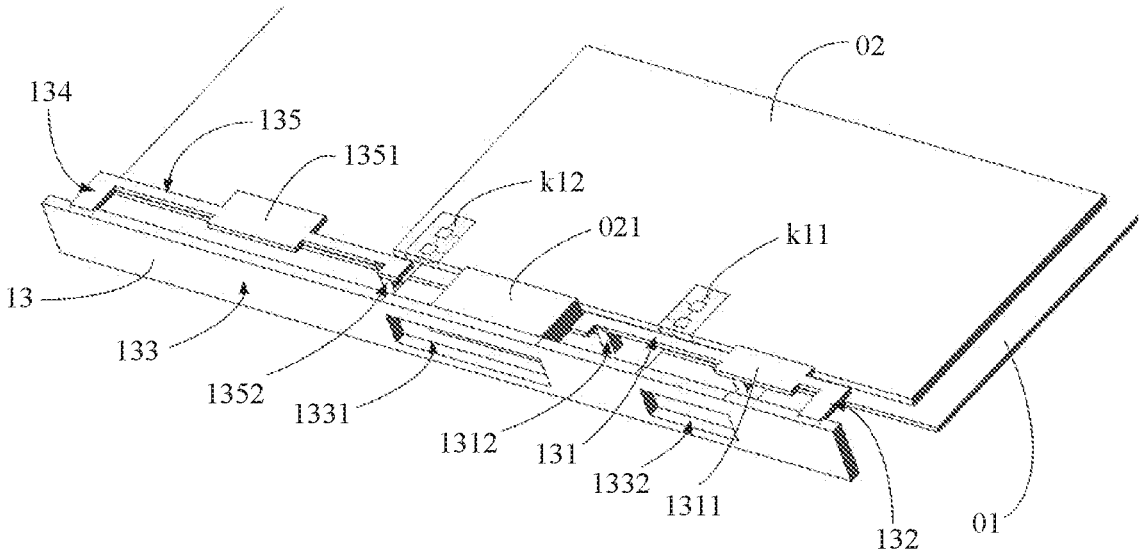
Figures 1, 2, 3, 4, 5, 6, 7, 8, 9, 10, 11, 12, 13, 14, 15:
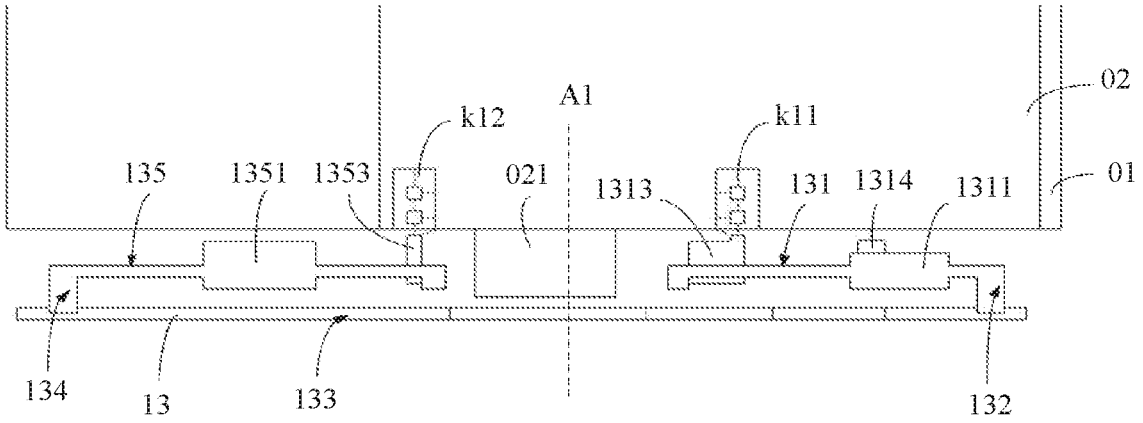
Figures 1, 2, 3, 4, 5, 6, 7, 8, 9, 10, 11, 12, 13, 14, 15, 16:
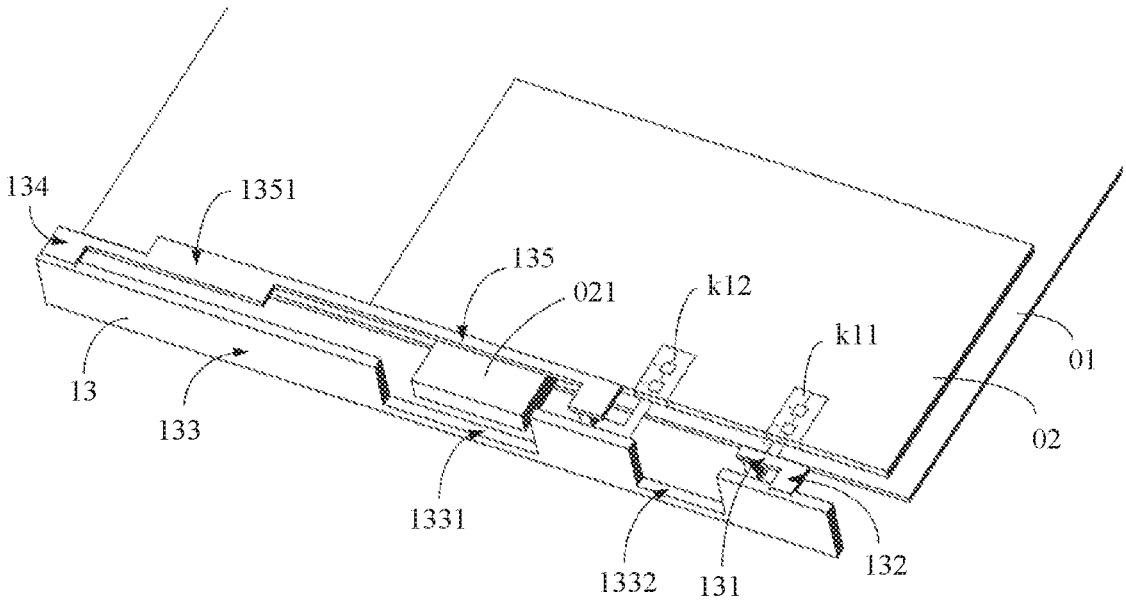
Figures 1, 2, 3, 4, 5, 6, 7, 8, 9, 10, 11, 12, 13, 14, 15, 16, 17:
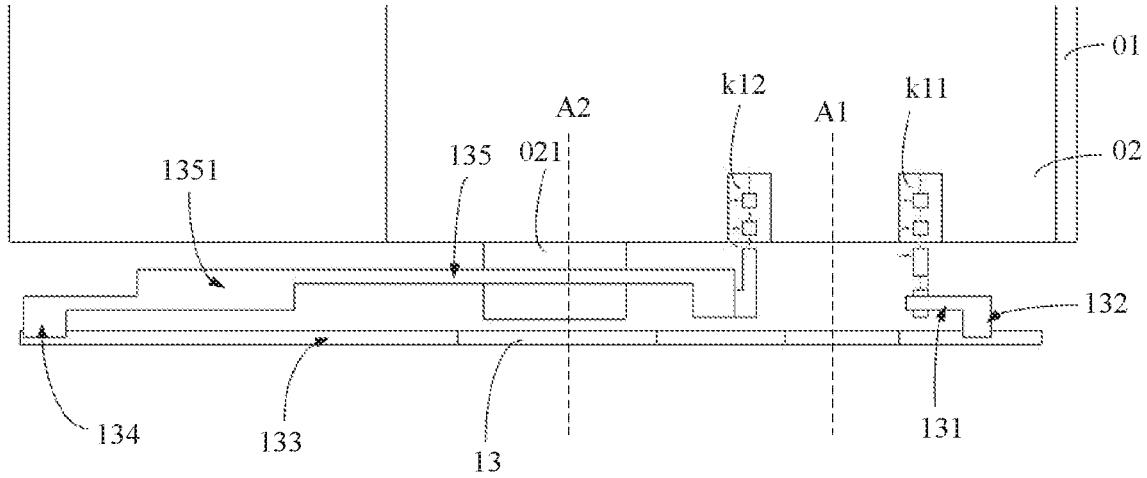
Figures 1, 2, 3, 4, 5, 6, 7, 8, 9, 10, 11, 12, 13, 14, 15, 16, 17, 18:
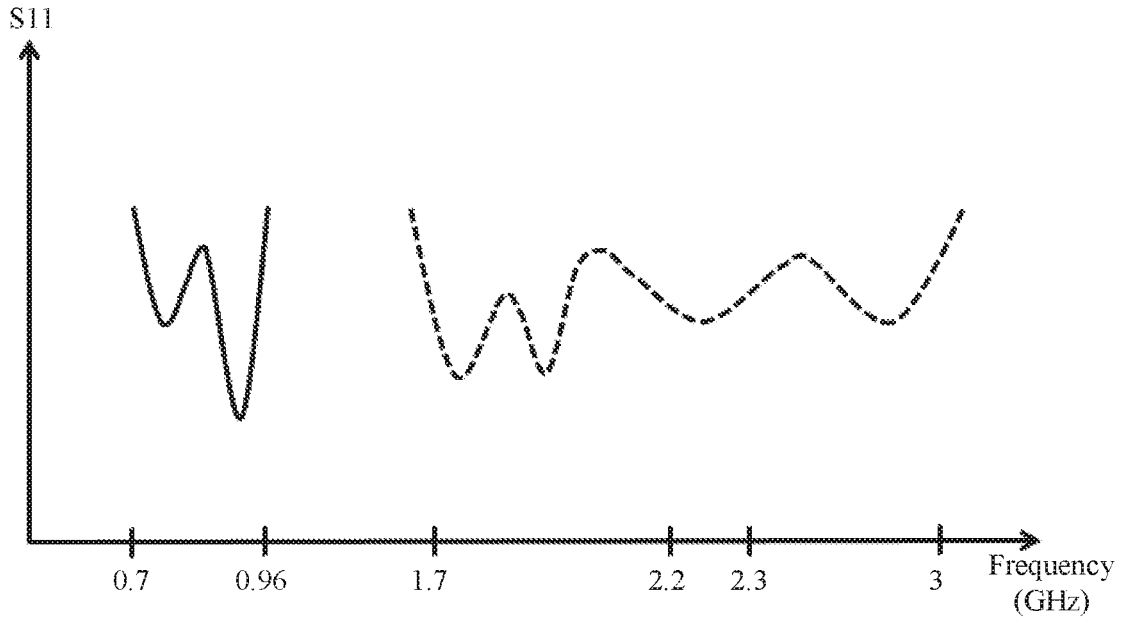
Figures 1, 2:
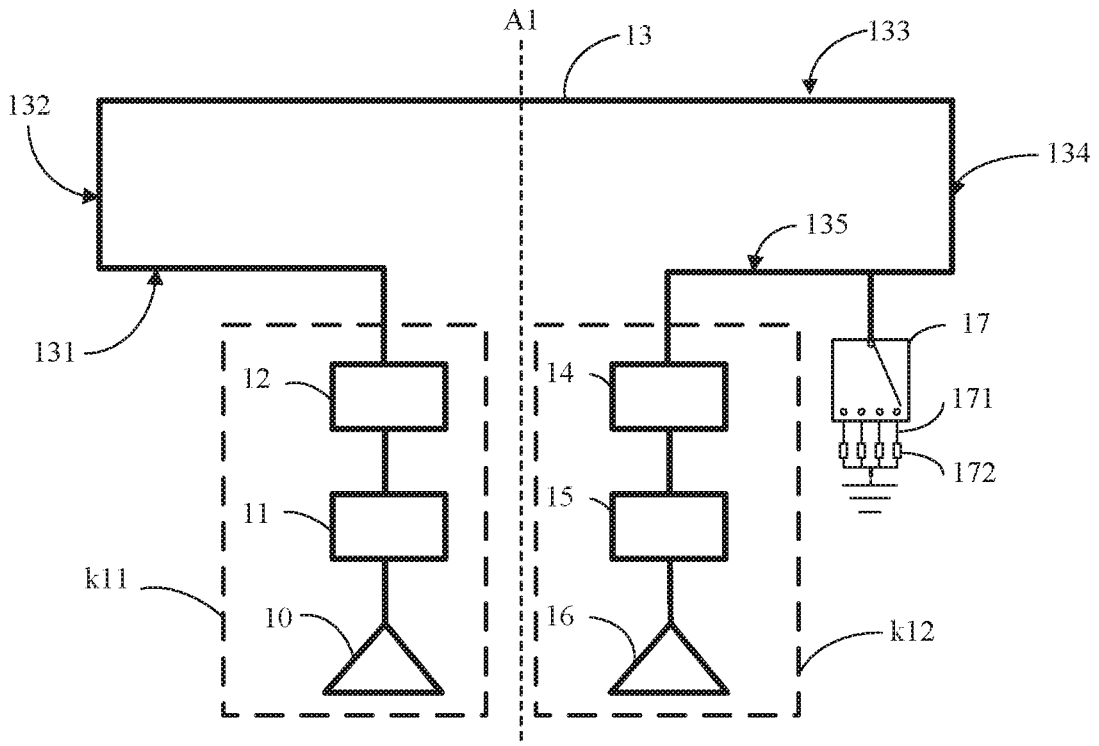
Figure 2:
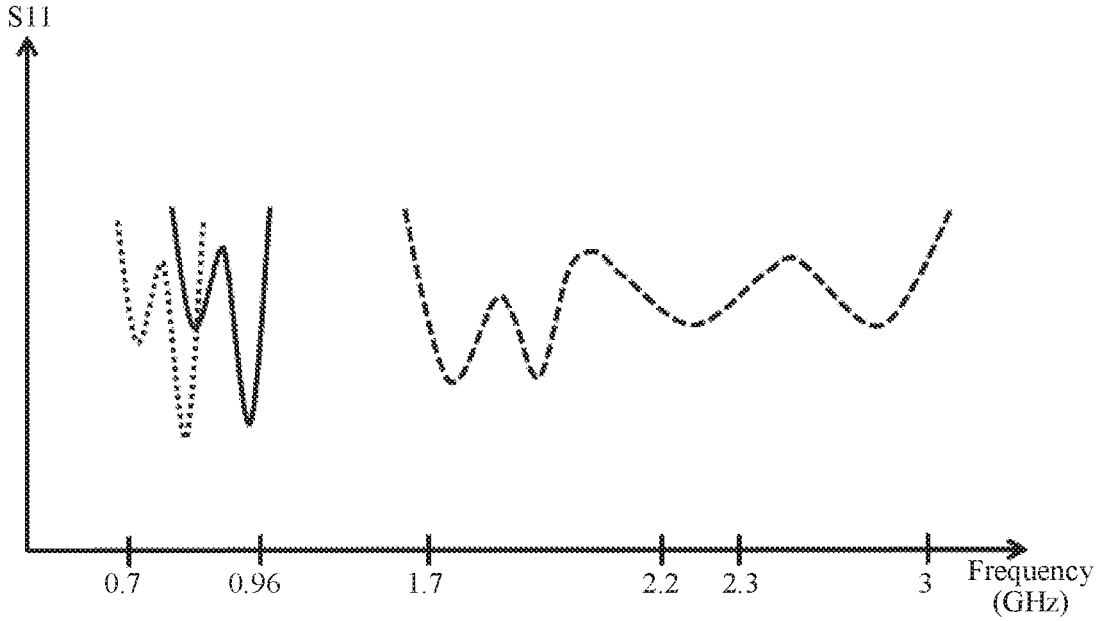
Figures 1, 3:
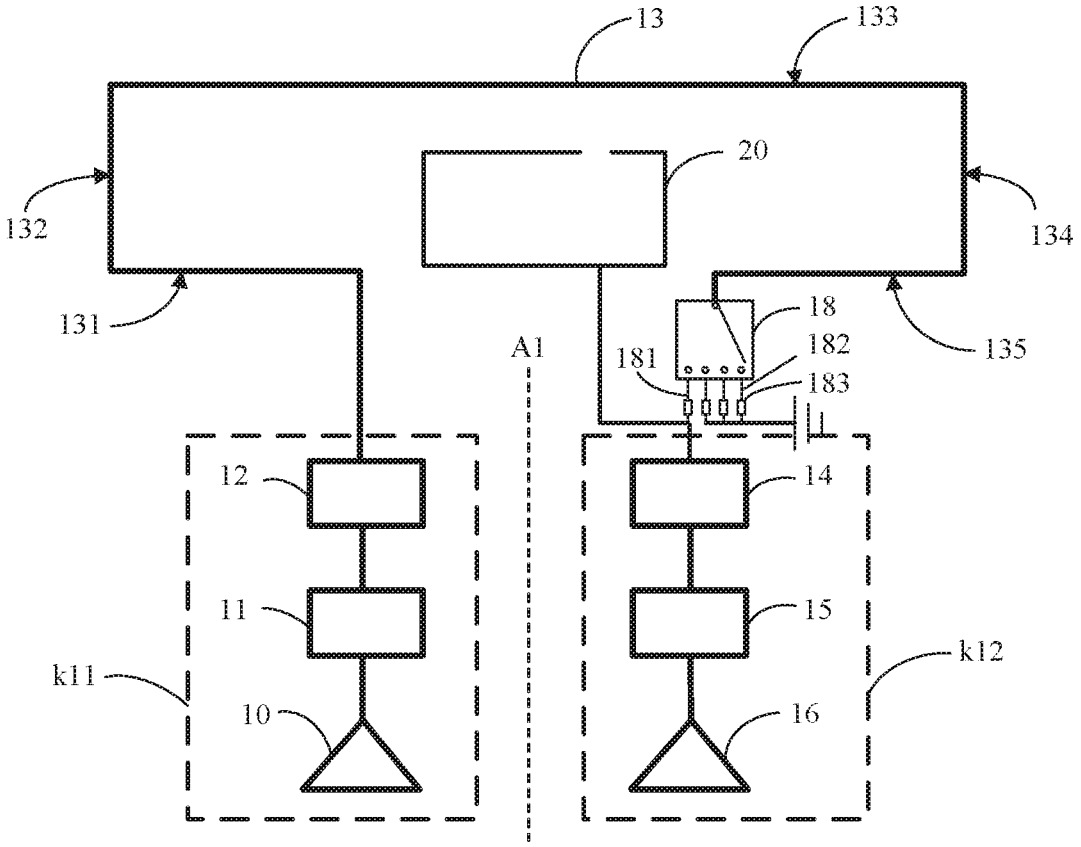
Figures 1, 4:
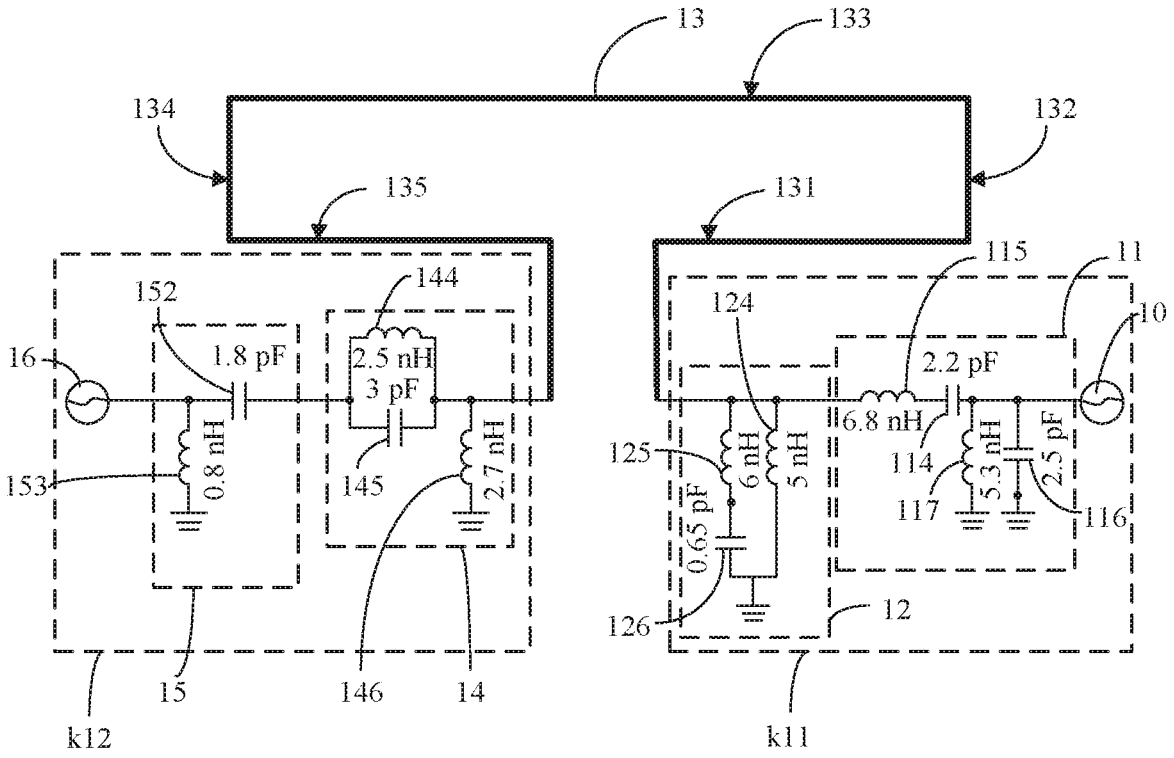
Figures 2, 4:
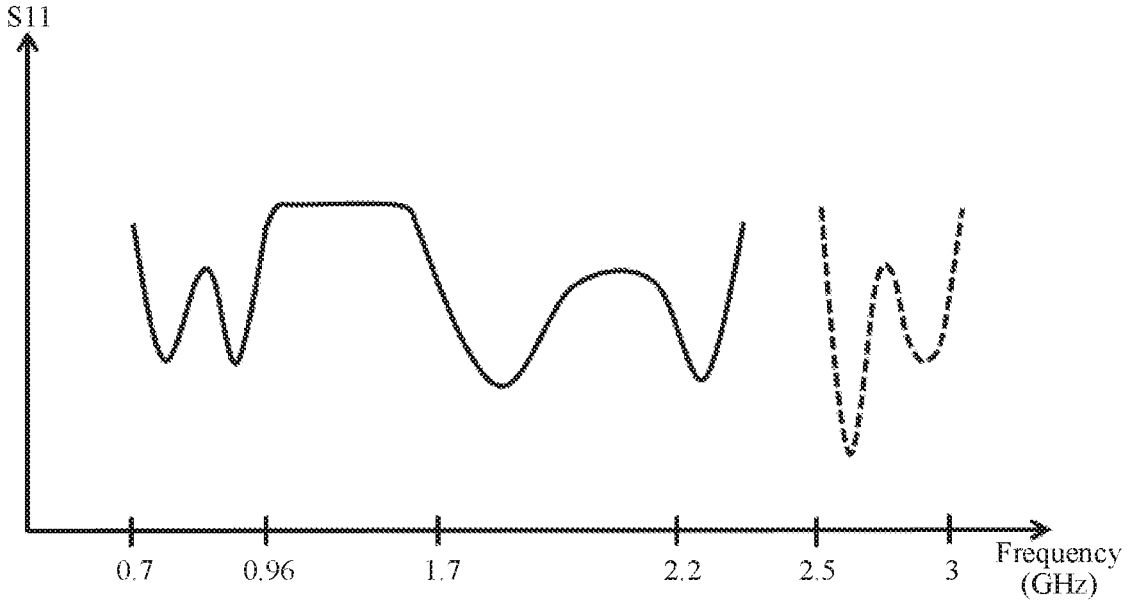
Figures 1, 5:
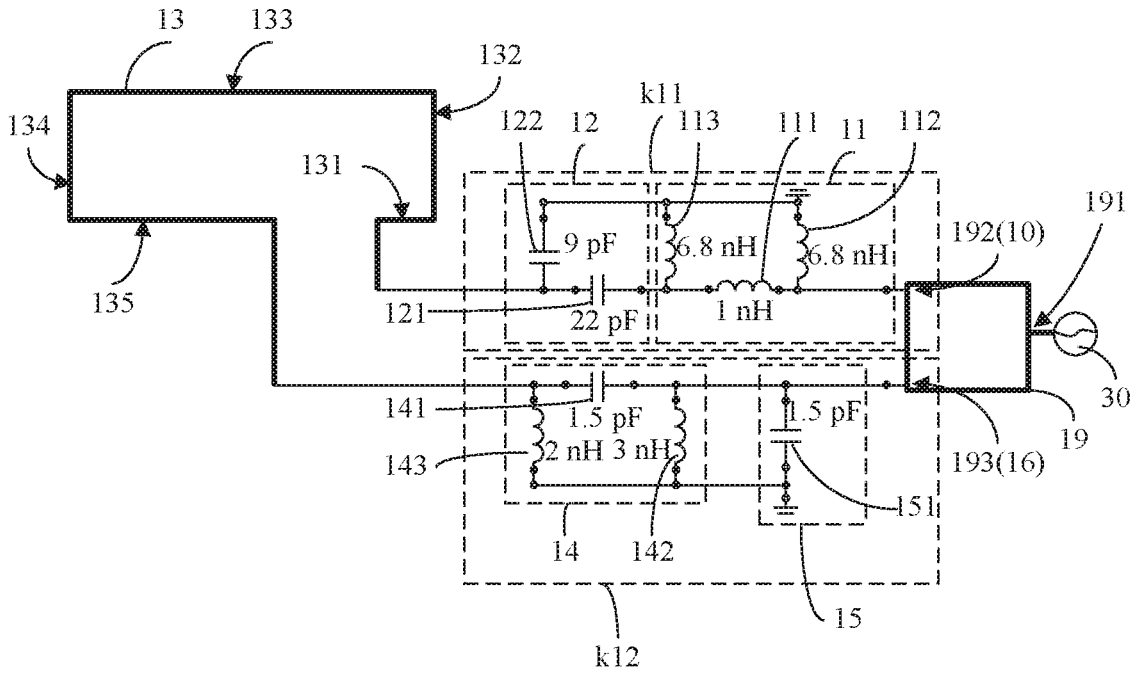
Figures 2, 5:
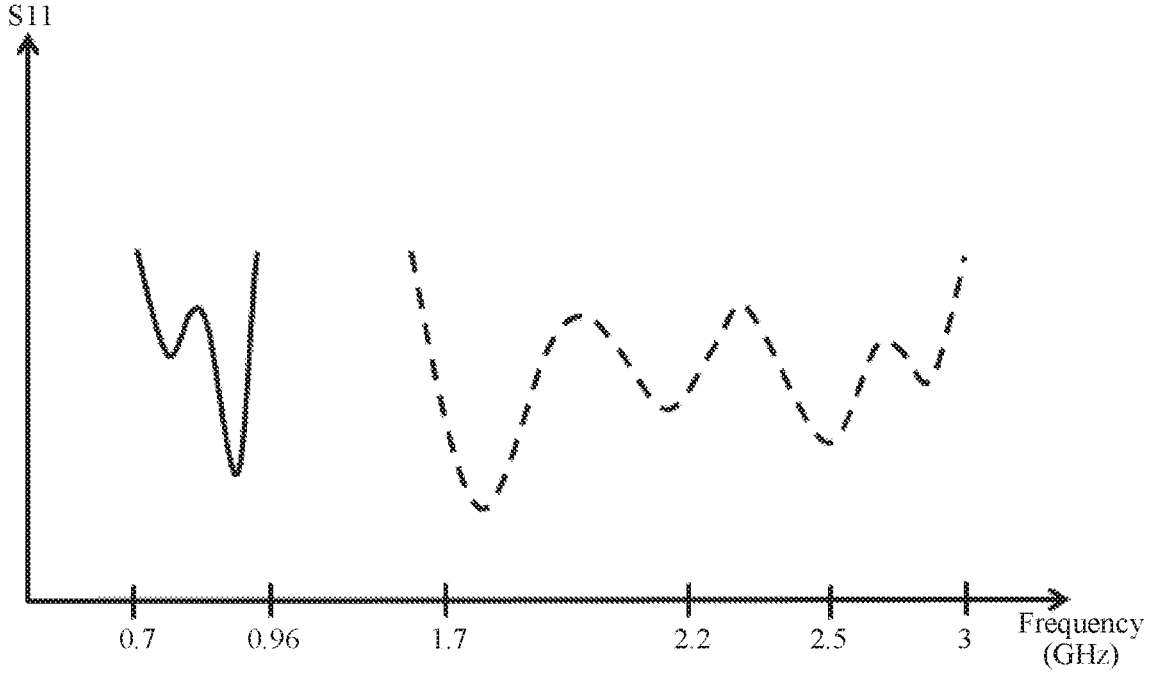

FIG. 5-1 is a schematic diagram of a circuit structure of an antenna apparatus according to a fifth embodiment of this application. The antenna apparatus is basically the same as an antenna apparatus in the first embodiment. However, a difference is that a duplexer 19 is disposed. The duplexer 19 includes an input port 191, a first output port 192, and a second output port 193. The first output port 192 is configured as the first feedpoint 10, and the second output port 193 is configured as the second feedpoint 16. The first filter circuit 12 is electrically connected to the first output port 192, the second filter circuit 14 is electrically connected to the second output port 193. The antenna apparatus further includes a general feedpoint 30. The general feedpoint 30 is electrically connected to the input port 191.

Specifically, a function of the duplexer 19 is to classify signals fed by the general feedpoint 30 into two paths of signals that are isolated from each other, to be specific, a signal that is of a first frequency band and that is output by the first output port 192 and a signal that is of a second frequency band and that is output by the second output port 192. In other words, the duplexer 19 is disposed, so that functions of a first feedpoint 10 and a second feedpoint 16 in the first embodiment can be implemented by disposing only the general feedpoint 30. In this way, a quantity of feedpoints is reduced. This facilitates a space layout of components inside a terminal.

It may be learned from the foregoing description that in this embodiment, a first feeding branch circuit k11 includes the first output port 192, a first matching circuit 11, and the first filter circuit 12, and a second feeding branch circuit k12 includes the second output port 193, a second matching circuit 15, and the second filter circuit 14.

The circuit structure in this embodiment is the same as a circuit structure in the first embodiment, and details are not described herein again.

An implementation of electrically connecting the first feeding branch circuit k11 and the second feeding branch circuit k12 to a radiator 13 is basically the same as an implementation of electrically connecting a first feeding branch circuit k11 and a second feeding branch circuit k12 to the first area B1 in the first embodiment. In this embodiment, a length of a first segment 441 is short, and a length of a fifth segment 445 is long, so that an offset feeding structure forms on the radiator 44. According to the disposing, the first feeding branch circuit k11 and the second feeding branch circuit k12 may be away from a location at which another component is arranged on the terminal. This facilitates a layout of the components of the terminal.

Certainly, the first feeding branch circuit k11 and the second feeding branch circuit k12 may be electrically connected to the radiator 13 in this embodiment by alternatively using an implementation of electrically connecting the first feeding branch circuit k11 and the second feeding branch circuit k12 to the second area B2.

FIG. 5-2 is a schematic diagram of S11 (input return loss) of an antenna apparatus shown in FIG. 5-1. It may be seen that there are two low resonance frequencies and four intermediate and high resonance frequencies. In this way, multi-frequency performance of the antenna apparatus is achieved.

The antenna apparatus and the terminal provided in the embodiments of this application are described in detail above. The principle and implementation of this application are described herein through specific examples. The description about the embodiments of this application is merely provided to help understand the method and core ideas of this application. In addition, a person of ordinary skill in the art can make variations and modifications to this application in terms of the specific implementations and application scopes according to the ideas of this application. Therefore, the content of specification shall not be construed as a limit to this application.

What is claimed is:

1. An antenna apparatus, comprising:

a radiator;

a first feeding branch circuit coupled to the radiator and comprising:

a first feedpoint configured to feed a first signal having a first frequency band; and a first filter circuit electrically coupled between the first feedpoint and the radiator, wherein the first filter circuit is configured to:

allow the first signal to pass through; and ground a second signal;

a second feeding branch circuit coupled to the radiator, wherein the radiator is positioned between the first feeding branch circuit and the second feeding branch circuit, and wherein the second feeding branch circuit comprises:

a second feedpoint configured to feed the second signal having a second frequency band; and a second filter circuit electrically coupled between the second feedpoint and the radiator, wherein the second filter circuit is configured to:

allow the second signal to pass through; and ground the first signal;

a duplexer comprising an input port, a first output port, and a second output port, wherein the first output port is configured as the first feedpoint, wherein the second output port is configured as the second feedpoint, wherein the first filter circuit is electrically coupled to the first output port, and wherein the second filter circuit is electrically coupled to the second output port; and a general feedpoint electrically coupled to the input port.

2. The antenna apparatus of claim 1, wherein the first feeding branch circuit further comprises a first matching circuit electrically coupled between the first feedpoint and the first filter circuit and configured to adjust a first resonance frequency of the first signal, and wherein the second feeding branch circuit further comprises a second matching circuit electrically coupled between the second feedpoint and the second filter circuit and configured to adjust a second resonance frequency of the second signal.

3. The antenna apparatus of claim 2, wherein the first feeding branch circuit and the second feeding branch circuit are symmetrically disposed on two sides of a centerline, and wherein the radiator comprises an architecture symmetrically distributed along the centerline.

4. The antenna apparatus of claim 2, wherein the first feeding branch circuit further comprises:

a ground;

a first inductor comprising:

a first end coupled to the first feedpoint; and a second end;
a second inductor comprising:
a third end coupled to the first feedpoint; and
a fourth end coupled to the ground;
a third inductor comprising:
a fifth end coupled to the second end; and
a sixth end coupled to the ground;
a first capacitor comprising:
a seventh end coupled to the second end; and
an eighth end; and
a second capacitor comprising:
a ninth end coupled to the eighth end and electrically coupled to the radiator; and
a tenth end coupled to the ground,
wherein the first inductor, the second inductor, and the third inductor form the first matching circuit, and
wherein the first capacitor and the second capacitor form the first filter circuit.

5. The antenna apparatus of claim 4, wherein the second feeding branch circuit further comprises:
a second ground;
a third capacitor comprising:
an eleventh end coupled to the second feedpoint; and
a twelfth end coupled to the second ground;
a fourth inductor comprising:
a thirteenth end coupled to the eleventh end; and
a fourteenth end coupled to the second ground;
a fourth capacitor comprising:
a fifteenth end coupled to the thirteenth end; and
a sixteenth end electrically coupled to the radiator; and
a fifth inductor comprising:
a seventeenth end coupled to the sixteenth end; and
an eighteenth end coupled to the second ground,
wherein the third capacitor forms the second matching circuit, and
wherein the fourth inductor, the fourth capacitor, and the fifth inductor form the second filter circuit.

6. The antenna apparatus of claim 2, wherein the first feeding branch circuit further comprises:
a ground;
a first capacitor comprising:
a first end; and
a second end coupled to the first feedpoint;
a second capacitor comprising:
a third end coupled to the first feedpoint; and
a fourth end coupled to the ground;
a third capacitor comprising:
a fifth end; and
a sixth end coupled to the ground;
a first inductor comprising:
a seventh end coupled to the first end; and
an eighth end coupled to the radiator;
a second inductor comprising:
a ninth end coupled to the third end; and
a tenth end coupled to the ground;
a third inductor comprising:
an eleventh end coupled to the eighth end; and
a twelfth end coupled to the ground; and
a fourth inductor comprising:
a thirteenth end electrically coupled to the radiator and the eleventh end; and
a fourteenth end coupled to the fifth end,
wherein the first capacitor, the second capacitor, the first inductor, and the second inductor form the first matching circuit, and
wherein the third capacitor, the third inductor, and the fourth inductor form the first filter circuit.

7. The antenna apparatus of claim 6, wherein the second feeding branch circuit further comprises:
a second ground;
a fourth capacitor comprising:
a fifteenth end coupled to the second feedpoint; and
a sixteenth end;
a fifth capacitor comprising:
a seventeenth end coupled to the sixteenth end; and
an eighteenth end electrically coupled to the radiator;
a fifth inductor comprising:
a nineteenth end coupled to the fifteenth end; and
a twentieth end coupled to the second ground;
a sixth inductor comprising:
a twenty first end coupled to the sixteenth end; and
a twenty second end electrically coupled to the radiator; and
a seventh inductor comprising:
a twenty third end electrically coupled to the radiator; and
a twenty fourth end coupled to the second ground,
wherein the fourth capacitor and the fifth inductor form the second matching circuit, and
wherein the fifth capacitor, the sixth inductor, and the seventh inductor form the second filter circuit.

8. The antenna apparatus of claim 1, wherein the radiator comprises a first area, a second area, and a third area, wherein the first area and the third area are disposed on two opposite sides of the second area, and wherein the first feeding branch circuit and the second feeding branch circuit are electrically coupled to the first area.

9. The antenna apparatus of claim 8, wherein the first feeding branch circuit and the second feeding branch circuit are symmetrically distributed on two sides of a first centerline, wherein the radiator comprises an architecture symmetrically distributed along a second centerline, and wherein the first centerline deviates from the second centerline.

10. The antenna apparatus of claim 1, further comprising:
a first switch electrically coupled to the radiator and disposed on a first side of the radiator that is proximate to the second feeding branch circuit; and
a ground branch coupled, in parallel, between the first switch and a ground,
wherein the first switch is configured to switch, using the ground branch, an electrical length of the first signal.

11. The antenna apparatus of claim 10, wherein an impedance component is disposed on the ground branch to adjust an electrical length of the radiator.

12. The antenna apparatus of claim 1, further comprising:
a radiation branch electrically coupled to an end of the second filter circuit;
a second switch;
a first ground branch comprising:
a first end coupled to the second switch; and
a second end coupled to the end of the second filter circuit; and
a second ground branch coupled in parallel between the second switch and a ground.

13. The antenna apparatus of claim 12, wherein the radiation branch is disposed to be separated from the radiator, and wherein an electrical length of the radiation branch is less than an electrical length of the radiator.

14. The antenna apparatus of claim 1,
wherein the duplexer is disposed to reduce a quantity of feedpoints.

15. A terminal, comprising:
a mainboard; and an antenna apparatus comprising:

a radiator;

a first feeding branch circuit disposed on the main board and coupled to the radiator and comprising:

a first feedpoint configured to feed a first signal of a first frequency band; and a first filter circuit electrically coupled between the first feedpoint and the radiator, wherein the first filter circuit is configured to:

allow the first signal to pass through; and ground a second signal;

a second feeding branch circuit disposed on the main board and coupled to the radiator, wherein the radiator is positioned between the first feeding branch circuit and the second feeding branch circuit, and wherein the second feeding branch circuit comprises:

a second feedpoint configured to feed the second signal of a second frequency band; and a second filter circuit electrically coupled between the second feedpoint and the radiator, wherein the second filter circuit is configured to:

allow the second signal to pass through; and ground the first signal;

a duplexer comprising an input port, a first output port, and a second output port, wherein the first output port is configured as the first feedpoint, wherein the second output port is configured as the second feedpoint, wherein the first filter circuit is electrically coupled to the first output port, and wherein the second filter circuit is electrically coupled to the second output port; and a general feedpoint electrically coupled to the input port.

16. The terminal of claim 15, further comprising a metal frame, wherein a part of the radiator is configured as the metal frame, and wherein the first feeding branch circuit and the second feeding branch circuit are electrically coupled to the metal frame.

17. The terminal of claim 16, further comprising a Universal Serial Bus (USB) interface, wherein the metal frame is configured as a frame on a side of the USB interface.

18. The terminal of claim 16, further comprising a Universal Serial Bus (USB) interface, wherein the first feeding branch circuit is disposed on a first side of the USB interface.

19. The terminal of claim 16, further comprising a Universal Serial Bus (USB) interface, wherein the second feeding branch circuit is disposed on a second side of the USB interface.

20. The terminal of claim 16, further comprising a Universal Serial Bus (USB) interface, wherein the first feeding branch circuit and the second feeding branch circuit are disposed on a same side of the USB interface.

* * * * *